US012410576B2

(12) United States Patent
Stell

(10) Patent No.: US 12,410,576 B2
(45) Date of Patent: Sep. 9, 2025

(54) SUPPORTING MASONRY BLOCK

(71) Applicant: Shoreloc Design Group, Inc., Largo, FL (US)

(72) Inventor: Jason Stell, Largo, FL (US)

(73) Assignee: Shoreloc Design Group, Inc., Largo, FL (US)

( * ) Notice: Subject to any disclaimer, the term of this patent is extended or adjusted under 35 U.S.C. 154(b) by 174 days.

(21) Appl. No.: 18/188,704

(22) Filed: Mar. 23, 2023

(65) Prior Publication Data

US 2023/0228056 A1 Jul. 20, 2023

Related U.S. Application Data

(63) Continuation-in-part of application No. 18/074,457, filed on Dec. 3, 2022, which is a continuation-in-part of application No. 17/737,477, filed on May 5, 2022, which is a continuation-in-part of application No. 17/066,656, filed on Oct. 9, 2020, now Pat. No. 11,352,760.

(51) Int. Cl.
*E02D 29/02* (2006.01)

(52) U.S. Cl.
CPC ..... *E02D 29/0266* (2013.01); *E02D 29/025* (2013.01); *E02D 2300/002* (2013.01); *E02D 2600/30* (2013.01)

(58) Field of Classification Search
CPC ..... E02D 29/025; E02D 29/0266; E02D 2300/002; E02D 2600/30; E02D 29/0241; E02D 29/0225; E02D 2600/20; E02D 5/74

See application file for complete search history.

(56) References Cited

U.S. PATENT DOCUMENTS

| | | | | |
|---|---|---|---|---|
| 4,619,560 | A | 10/1986 | Crinnion | |
| 5,484,236 | A | 1/1996 | Gravier | |
| 5,816,749 | A | 10/1998 | Bailey, II | |
| 5,951,210 | A | 9/1999 | Maguire | |
| 6,416,260 | B1 | 7/2002 | Khamis | |
| 6,543,969 | B1 | 4/2003 | Adam | |
| 6,854,220 | B2 | 2/2005 | Dueck et al. | |
| 6,935,812 | B2 * | 8/2005 | Rainey | E02D 29/0225 405/262 |
| 6,978,580 | B1 | 12/2005 | Clark et al. | |
| 7,037,047 | B1 | 5/2006 | Tufts et al. | |
| 7,096,634 | B2 | 8/2006 | Dean, Jr. | |
| 7,168,892 | B1 | 1/2007 | MacDonald | |
| 7,244,079 | B1 | 7/2007 | Blomquist et al. | |

(Continued)

FOREIGN PATENT DOCUMENTS

| | | |
|---|---|---|
| KR | 300513040.0000 | 12/2008 |
| KR | 2018094268 | 8/2018 |

(Continued)

*Primary Examiner* — Carib A Oquendo
(74) *Attorney, Agent, or Firm* — Larson & Larson; Frank Liebenow

(57) ABSTRACT

A supporting masonry block has a supporting masonry block body having a front surface, a back surface, a top surface, a bottom surface, a first side and a second side. The front surface has a front-top edge and a front-bottom edge. A tie-back receptacle passes from the top surface, through to the bottom surface. The tie-back receptacle is open to the back surface for connecting the supporting masonry block to a tie-back.

15 Claims, 28 Drawing Sheets

(56) References Cited

U.S. PATENT DOCUMENTS

| | | | | |
|---|---|---|---|---|
| 7,384,215 | B2 | 6/2008 | Woolford | |
| D587,382 | S | 2/2009 | Wauhop | |
| 7,712,281 | B2 | 5/2010 | Bott | |
| 7,963,727 | B1 | 6/2011 | Wauhop | |
| D645,575 | S | 9/2011 | Bone | |
| D663,858 | S | 7/2012 | MacDonald | |
| D671,657 | S | 11/2012 | MacDonald | |
| D685,502 | S | 7/2013 | MacDonald | |
| D708,765 | S | 7/2014 | MacDonald | |
| D711,014 | S | 8/2014 | MacDonald | |
| 9,701,046 | B2 | 7/2017 | Karau | |
| 10,202,756 | B2 * | 2/2019 | Dean | E04B 2/54 |
| D846,760 | S | 4/2019 | Lundell et al. | |
| D866,004 | S | 11/2019 | Johnson | |
| 10,583,588 | B2 | 3/2020 | Karau | |
| D900,342 | S | 10/2020 | Rainey | |
| D919,838 | S | 5/2021 | Kloss et al. | |
| 2002/0023403 | A1 | 2/2002 | Whitson | |
| 2002/0083657 | A1 | 7/2002 | Mattox et al. | |
| 2003/0213203 | A1 * | 11/2003 | Bott | E02D 29/0241 52/603 |
| 2007/0175161 | A1 | 8/2007 | Sunseth et al. | |
| 2008/0277561 | A1 | 11/2008 | MacDonald | |
| 2011/0192097 | A1 * | 8/2011 | Kelley, Jr. | E02D 29/0241 52/592.5 |
| 2011/0217127 | A1 | 9/2011 | MacDonald | |
| 2014/0037389 | A1 | 2/2014 | Welling | |
| 2016/0130780 | A1 * | 5/2016 | Castonguay | E02D 29/0233 405/284 |

FOREIGN PATENT DOCUMENTS

| | | | |
|---|---|---|---|
| KR | 101961430 | B1 | 3/2019 |
| KR | 102173364 | B1 | 11/2020 |

* cited by examiner 200
200
200

SUPPORTING MASONRY BLOCK

CROSS-REFERENCE TO RELATED APPLICATION

This application is a continuation-in-part of U.S. patent application Ser. No. 18/074,457, filed Dec. 3, 2022; which in turn is a continuation-in-part of U.S. patent application Ser. No. 17/737,477, filed May 5, 2022, which in turn is a continuation-in-part of U.S. patent application Ser. No. 17/066,656, filed Oct. 9, 2020 and issued as U.S. patent Ser. No. 11/352,760 on Jun. 7, 2022, the disclosure of which is hereby incorporated by reference.

FIELD OF THE INVENTION

This invention relates to the field of wall/barrier construction and more particularly to a supporting masonry block, for example for construction of retaining walls.

BACKGROUND OF THE INVENTION

Masonry blocks of concrete blocks have many uses such as soil retention, retaining walls, and landscaping. There are many masonry blocks in existence today, each with their range of uses and aesthetic properties. One simple example is what is known as a cinder block. A cinder block is a block made of concrete and cinder, making it lighter weight than a block made entirely of concrete. Cinder blocks are generally used in foundations and walls of buildings, typically laid in an alternating pattern and held together with mortar. Such construction provides very good load bearing, but does not provide sufficient sheer strength, for example, for retaining soil as the weight of the soil and water held by the soil presents a high amount of sheer force against a retaining wall.

A retaining wall requires extra sheer strength to prevent the retaining wall from sliding, bowing, or collapsing due to the material that is being retained such as soil, sand, stone, often having various amounts of water due to rain and runoff. Currently, many different materials are used to make retaining walls. The material used depends upon the application and size of the wall. For example, a retaining wall that supports a roadway is often made of a steel wall or a concrete and steel wall while a retaining wall for landscaping is often made of a material with aesthetic values such as railroad ties or solid concrete blocks.

Generally, for many retaining walls of small heights, typically less than six feet high, there is not much pressure from the material being retained (e.g., soil) and not too much engineering required as the weight of the blocks are typically sufficient to prevent shifting from pressure of the material being retained. Many concrete blocks are available for such use in home improvement stores and many home projects are successfully completed, building such retaining walls by those who are not skilled in engineering of larger projects.

As the height of the retaining wall increases, so does the pressure exerted against the concrete blocks used to fabricate the retaining wall. Building walls that are higher than six feet high requires special skill as they must be engineered to resist the sheer force exerted from the soil, rock, and water that is being retained behind the wall. In recent years, a layer of geogrid has been deployed between blocks of such walls. Each layer of geogrid is laid between the blocks and stone is backfilled on top of the geogrid, layer by layer. In this way, the geogrid provides additional resistance to sheer forces from behind the retaining wall.

There are several engineering parameters designed to provide sufficient sheer strength to a retaining wall made of concrete blocks. One parameter is "setback" which is generally considered the distance in which one course of a wall extends beyond the front surface of the next highest course of the wall. This angle of the retaining wall counter acts the pressure of the soil behind the wall. For example, a wall of standard clay bricks having no setback is easy to push over but setting each brick back ½ inch from the lower brick makes it difficult to push over from the back.

Other engineering issues for concrete blocks used to make a retaining wall include friction between successive blocks. This friction is enhanced by the weight of successive blocks (those above) making it difficult for the concrete blocks to slide on each other which would result in holes in the retaining wall or total failure/collapse.

In some retaining wall construction, it is desired to limit the setback as, in some applications, there is insufficient space to construct a retaining wall that has the required setback. This may be due to a property line or a roadway configuration not providing ample space to properly setback the retaining wall. In such, the concrete blocks must be able to create a retaining wall that is virtually vertical while resisting the sheer force of the material held behind the retaining wall. In such applications, the retaining wall is further supported through the use of various construction techniques such as pins (e.g., a length of rebar passing vertically through the retaining wall), deadheads, tie-backs, etc. The engineering and construction of such is complicated and relies on the added support construction which, if a failure occurs such as the rebar rusts, the entire retaining wall is compromised.

Another issue with prior concrete block construction is curves, both convex and concave. When using a conventional block system having rectangular blocks to create a concave retaining wall, the rectangular blocks just touch at one point adjacent to the faces of the blocks, reducing friction between adjacent blocks to only that point only. Therefore, lateral soil pressure from behind the retaining wall pushes against each individual block and, having only one point of side resistance, such a block has little resistance to lateral soil pressure. For a convex retaining wall, the same situation occurs, only the touch point is at the back corners of the blocks, though another issue occurs in that the faces of the blocks are separated by a space that is proportional to a radius of the convex curve, which is often not desired for aesthetic reasons.

Another issue with prior concrete block construction is corners. When using a conventional block system having rectangular blocks to create a corner, the rectangular blocks are typically placed in an alternating pattern at the corner creating somewhat of a zipper pattern. As there is nothing other than friction to keep the corner blocks of the prior art in place, soil, and water pressure from behind the retaining wall pushes against each individual corner block and, having only friction to resist such pressure, such construction often fails at the corners.

As with many types of construction, there are those who can understand and engineer walls made of concrete blocks (engineers), and there are those who construct walls made of concrete blocks (builders). For many projects, the engineering and construction is left to builders when there is often a need for engineering which should be performed before the wall is constructed. Further, even when properly engineered, some builders don't understand and/or don't follow the engineered design and the resulting concrete block wall has the potential to fail under certain load conditions. It is preferred that the concrete blocks provide features that make it difficult or impossible to construct a concrete block wall that does not conform to designed engineering constructs such as curvature radius and block-to-block setback.

What is needed is a corner concrete block system that will provide structural strength while enabling corners at desired angles.

SUMMARY OF THE INVENTION

In one embodiment, a supporting masonry block is disclosed including a supporting masonry block body that has a front surface, a back surface, a top surface, a bottom surface, a first side and a second side. The front surface has a front-top edge and a front-bottom edge. A tie-back receptacle passes from the top surface, through to the bottom surface. The tie-back receptacle is open to the back surface for connecting the supporting masonry block to a tie-back.

In another embodiment, including method of constructing a structure with masonry blocks is disclosed including setting a supporting masonry block that has a front surface, a back surface, a top surface, a bottom surface, the front surface having a front-top edge and a front-bottom edge, and a tie-back receptacle passing from the top surface, through to the bottom surface. The tie-back receptacle is open to the back surface for connecting the supporting masonry block to a tie-back. The method includes setting a second masonry block onto the supporting masonry block. The second masonry block has a second masonry block bottom surface and a second masonry block front surface.

In another embodiment, a masonry block system is disclosed including a supporting masonry block that has a front surface, a back surface, a top surface, a bottom surface, and side surfaces. The front surface has a front-top edge and a front-bottom edge. A tie-back receptacle passes from the top surface, through to the bottom surface. The tie-back receptacle is open to the back surface for connecting the supporting masonry block to a tie-back. The System includes one or more masonry blocks. Each masonry block of the one or more masonry blocks has a second front surface, a second back surface, a second top surface, a second bottom surface, and second side surfaces, the second front surface having a second front-top edge and a second front-bottom edge. There is a mechanism for stacking the one or more masonry blocks above the supporting masonry block such that each layer of the one or more masonry blocks are set back from the supporting masonry block or a lower layer of the one or more masonry blocks by a fixed setback distance.

BRIEF DESCRIPTION OF DRAWINGS

The invention can be best understood by those having ordinary skill in the art by reference to the following detailed description when considered in conjunction with the accompanying drawings in which.

DETAILED DESCRIPTION OF THE INVENTION

Figure 1:
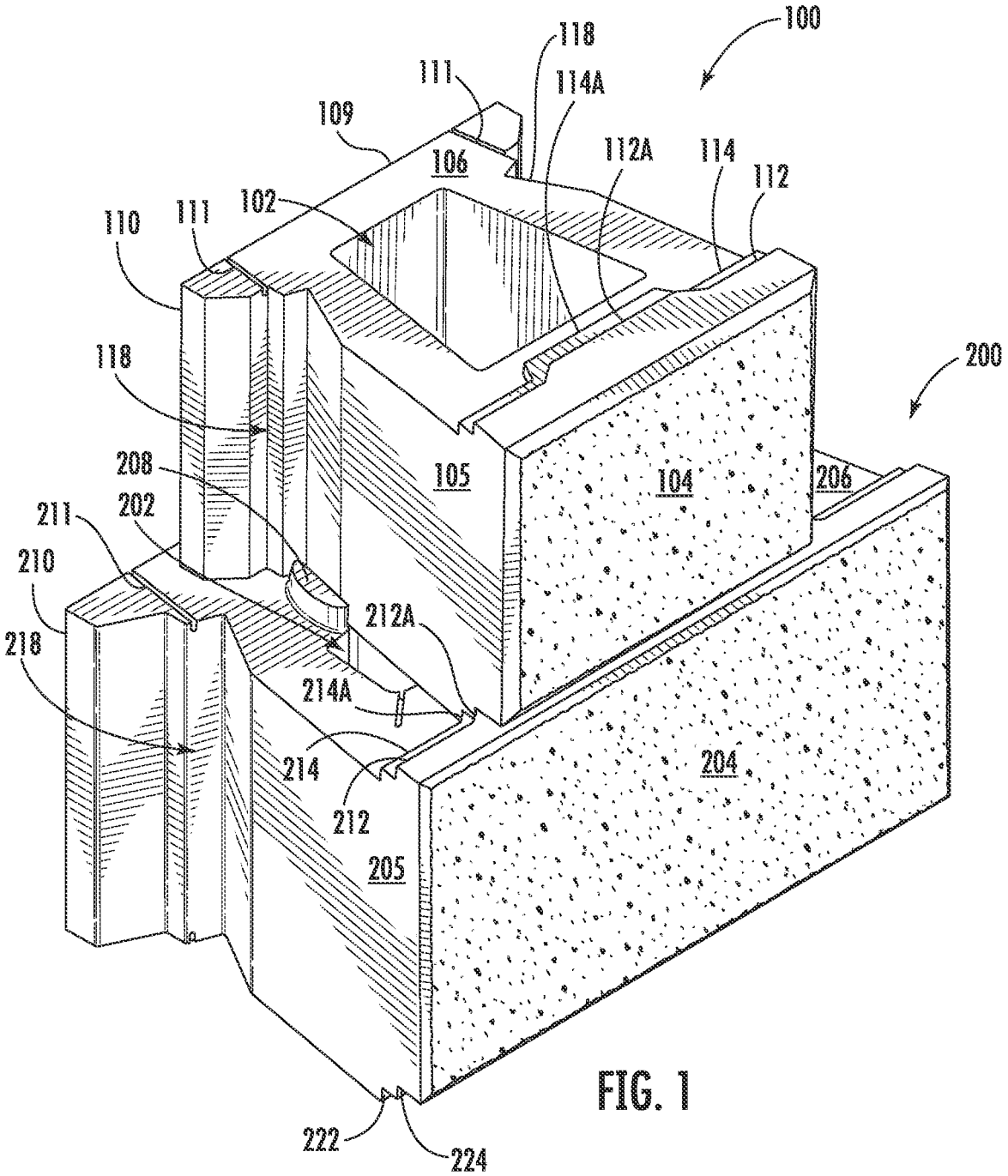
FIG. 1 illustrates a perspective view of a small masonry block positioned atop a large concrete block.

Reference will now be made in detail to the presently preferred embodiments of the invention, examples of which are illustrated in the accompanying drawings. Throughout the following detailed description, the same reference numerals refer to the same elements in all figures.

Throughout this description, several features of the disclosed supporting masonry block are referred to using a common terminology. In some embodiments, there are break points which are score lines in the supporting masonry block that permit clean breaks of the supporting masonry block along the score lines, typically using a simple tool such as a hammer and chisel. In some embodiments, the front top edge of the disclosed supporting masonry block has steps that mate with notches along the front bottom edge of the next higher masonry block.

Throughout this document, the features of the supporting masonry block are described with respect to the outwardly facing surface of the supporting masonry block body being referred to as the front, the surface that is mostly visible from the outside of the wall when the masonry blocks are incorporated into a wall. The bottom is the surface that, when installed in a wall, is at a lowest altitude and touches the next lower masonry block or ground surface/footings. The top is the surface that, when installed, is distal from the next lower masonry block and, if a subsequently higher layer of concrete blocks is included, the top of the supporting masonry block contacts the bottom of masonry blocks of the subsequently higher layer of masonry blocks. The back is the surface that is opposite of the front and typically is in direct contact with the material being retained by the wall, for example, soil, rocks, etc.

Throughout this description, a large masonry block 200 and a small masonry block 100 are described, large and small being relative to the size of each other masonry block 100/200. The described masonry blocks 100/200 are designed to create structurally sound walls using either all small masonry blocks 100, all large masonry blocks 200 or any combination of masonry blocks 100/200. Note that although the primary composition of the masonry blocks 100/200 is concrete, it is fully anticipated that other materials are included in the masonry blocks 100/200 such as strengtheners, fillers, and/or moisture.

The masonry blocks 100/200 and supporting masonry block 500 are disclosed having steps on a top surface and notches on a bottom surface. Although it is anticipated to include the steps on the bottom surface and the notches on the top surface, it is preferred to have the steps on the top surface and notches on the bottom surface, leaving the bottom surface relatively flat for interfacing with transportation (e.g., palettes, truck floors) and for interfacing with footings.

The described masonry blocks 100/200 and supporting masonry blocks 500 are typically formed by filling a mold with a masonry material (e.g., concrete, moisture, filler) and applying pressure to form the masonry blocks 100/200 and/or supporting masonry block 500, then allowing the masonry blocks 100/200 and/or supporting masonry block 500 to set either in open air or in a temperature/humidity-controlled environment.

Figure 2:
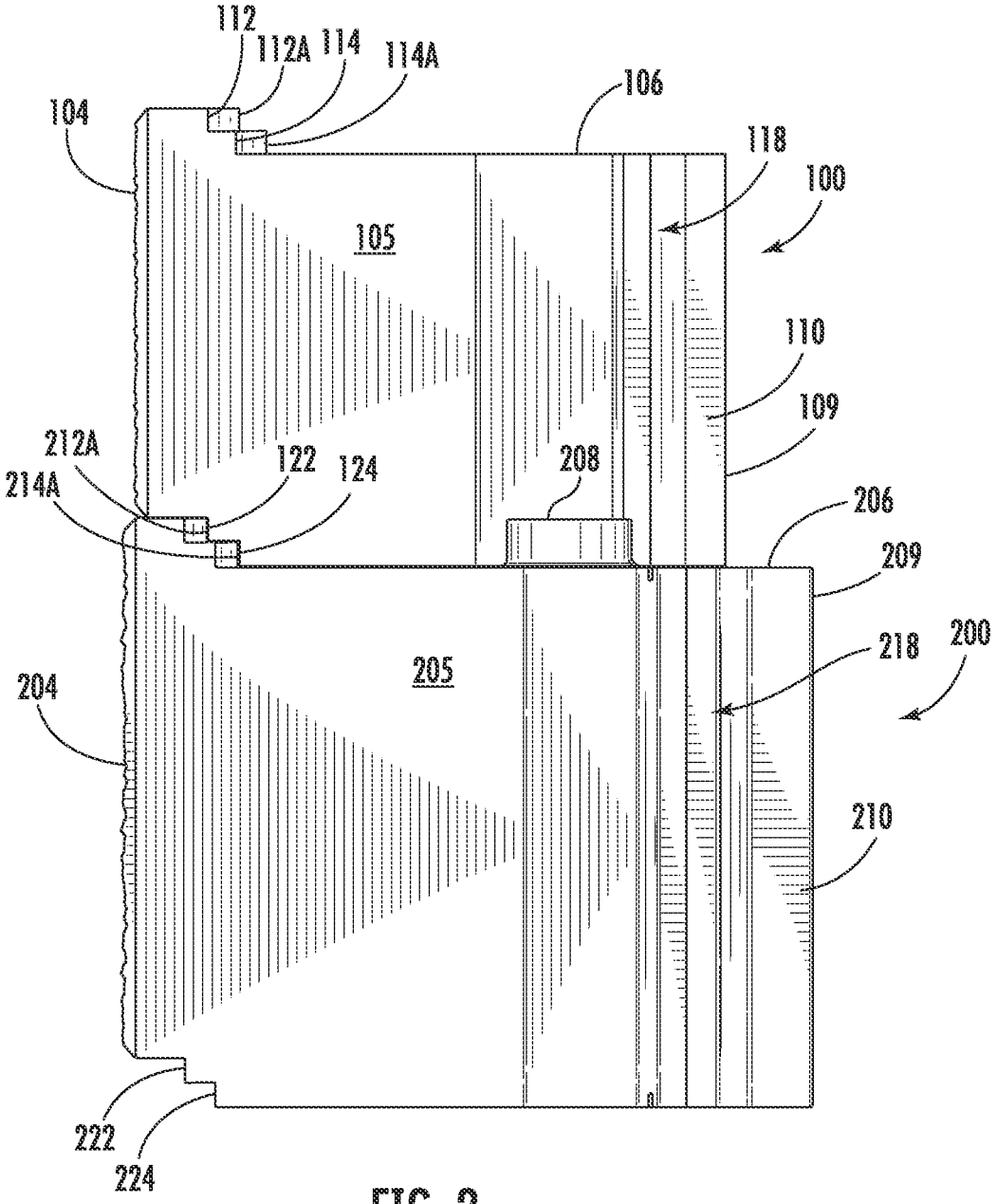
FIG. 2 illustrates a side view of the small masonry block positioned atop a large concrete block.

Referring to FIGS. 1 and 2, views of a small masonry block 100 positioned atop a large masonry block 200 are shown. Although, in FIGS. 1 and 2, it is shown how the small masonry block 100 interfaces with the large masonry block 200, any configurations of small masonry block 100 and large masonry block 200 are anticipated including walls made entirely of either small masonry blocks 100 or walls made entirely of large masonry blocks 200.

The large masonry block 200 has a large masonry block front 204 (the face part that is visible when built into a wall) with large masonry block sides 205 having large masonry block insets 218 and large masonry block legs 210. There is a large masonry block opening 202, the purpose of such is for reducing the total weight of the large masonry block 200.

The small masonry block 100 has a small masonry block front 104 (the face part that is visible when built into a wall) with small masonry block sides 105/107 having small masonry block insets 118 and small masonry block legs 110. There is a small masonry block opening 102, the purpose of such is for reducing the total weight of the small masonry block 100.

The small masonry block top surface 106 has small masonry block steps 112/114/112A/114A. As either of the small masonry block 100 or large masonry block 200 are stacked upon each other, the steps (small masonry block steps 112/114/112A/114A or large masonry block steps 212/214/212A/214A) mate with notches of the masonry block above (small masonry block notches 122/124 or large masonry block notches 222/224). This mating helps make sure that the proper setback is made (note the forced setback shown in FIG. 1) and also provides structural support keeping upper layers of the masonry blocks 100/200 from being pushed out with respect to lower layers of the masonry blocks 100/200. Note how the small masonry block steps 112/114/112A/114A and large masonry block steps 212/214/212A/214A are staggered (not linear) providing bumps to assist in forming curved walls from multiple of the masonry blocks.

Also shown in FIG. 1, the large masonry block key 208 of the large masonry block top surface 206 rests against the side of the small masonry block 100. The mating of the large masonry block key 208 with the small masonry block side 105 of the small masonry block 100 helps make sure that proper spacing is maintained as well as limiting lateral movement of successive layers of the masonry blocks 100/200.

Note that the small masonry block steps 112/114/112A/114A include outer small masonry block steps 112/114 and inner small masonry block steps 112A/114A. The purpose of such is to provide maximum step contact with the notches (small masonry block notches 122/124 or large masonry block notches 222/224) of subsequent higher layers of the masonry blocks 100/200 when the masonry blocks 100/200 are arranged in a concave formation. Note that the small masonry block notches 122/124 and large masonry block notches 222/224 are substantially linear.

The small masonry block 100 has a small masonry block top surface 106 and small masonry block legs 110. The large masonry block 200 has a large masonry block top surface 206 and large masonry block legs 210.

The large masonry block legs 210 have score lines 211 for knocking off the large masonry block legs 210 in a predictable way with a simple tool such as a hammer and chisel.

Figure 3:
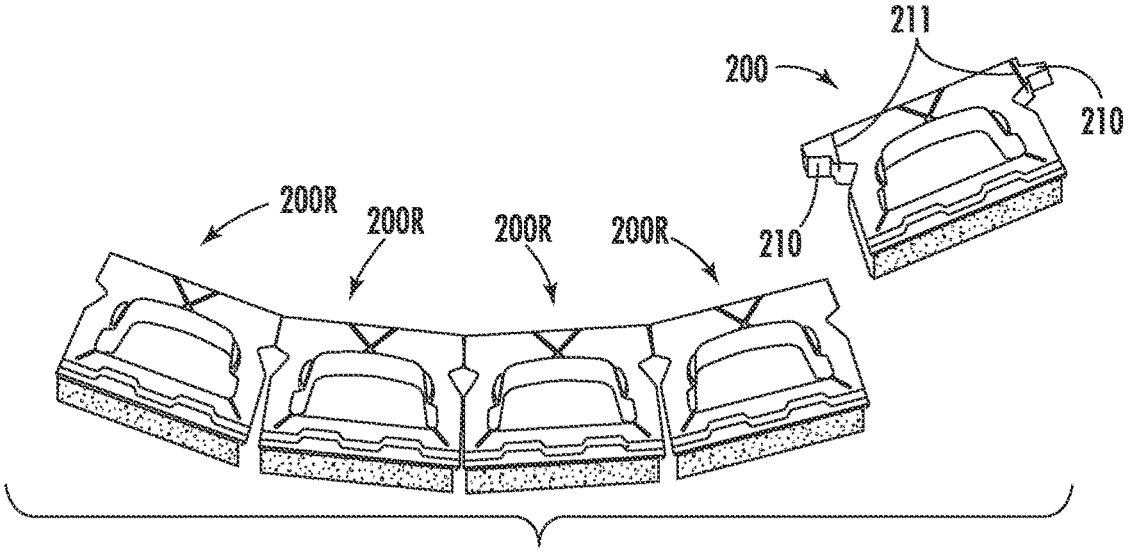
FIG. 3 illustrates a plan view of several of the large masonry blocks arranged in a convex curve in which another large masonry block is to be added.
Figure 4:
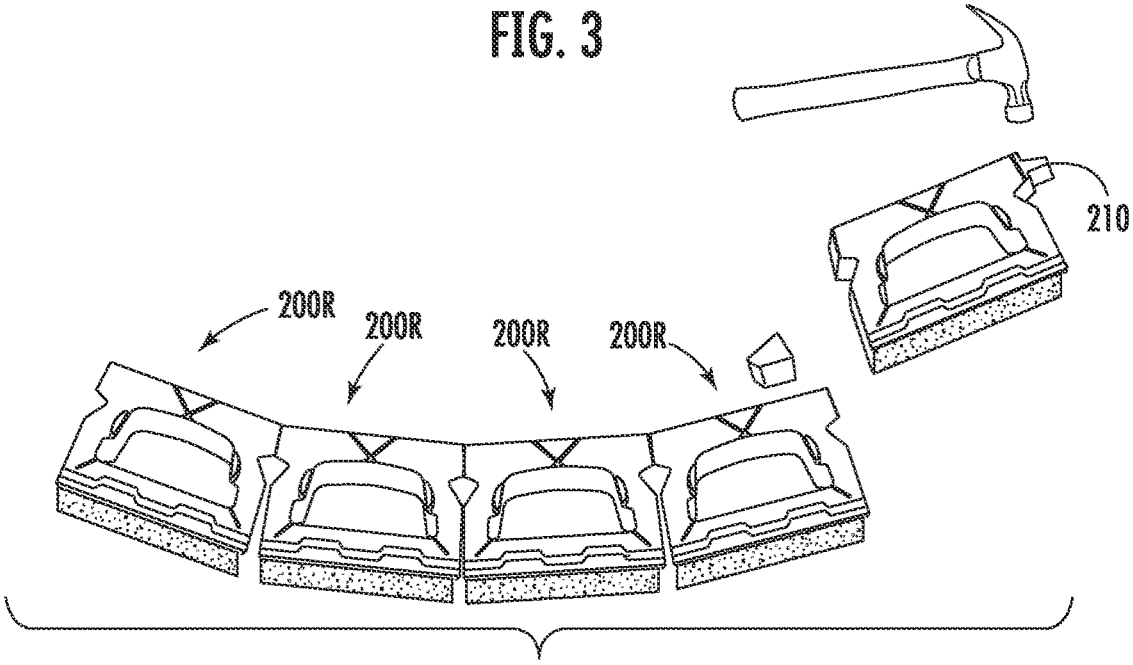
FIG. 4 illustrates a second plan view of several of the large masonry blocks arranged in a convex curve in which another large masonry block is modified by breaking off the legs along the score line.
Figure 5:
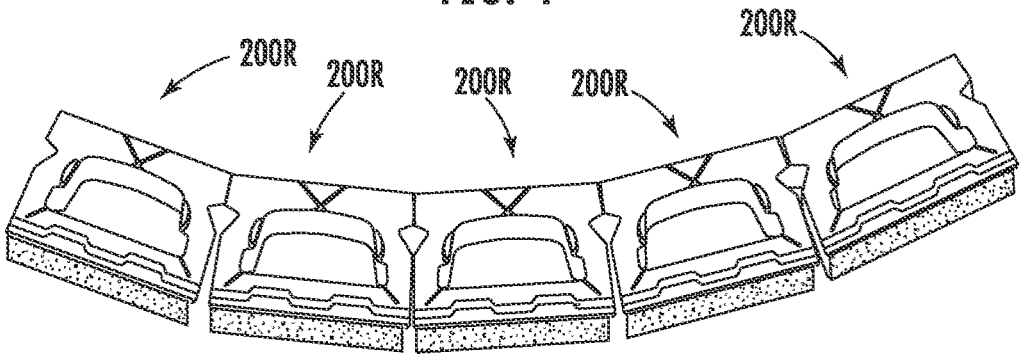
FIG. 5 illustrates a second plan view of several of the large masonry blocks arranged in a convex curve in which another large masonry block is added into the convex curve after being modified by breaking off the legs along the score line.

Referring to FIGS. 3, 4, and 5, plan views of several of the large masonry blocks 200R arranged in a convex curve are shown in which another large masonry block 200 is to be added. It is difficult to form curved walls using masonry blocks of the prior art, often requiring cutting of such blocks to form the curved wall. As shown in FIGS. 3, 4, and 5, by knocking off the large masonry block legs 210 of each large masonry block 200, a wall with a specific radius is formed. Note, walls of different radii are anticipated based upon setting each of the masonry blocks 100/200 with their sides abutting near the front of the masonry blocks 100/200 and setting the distance between the masonry block legs 110/210 (or sides after removal of the masonry block legs 110/210).

Figure 6:
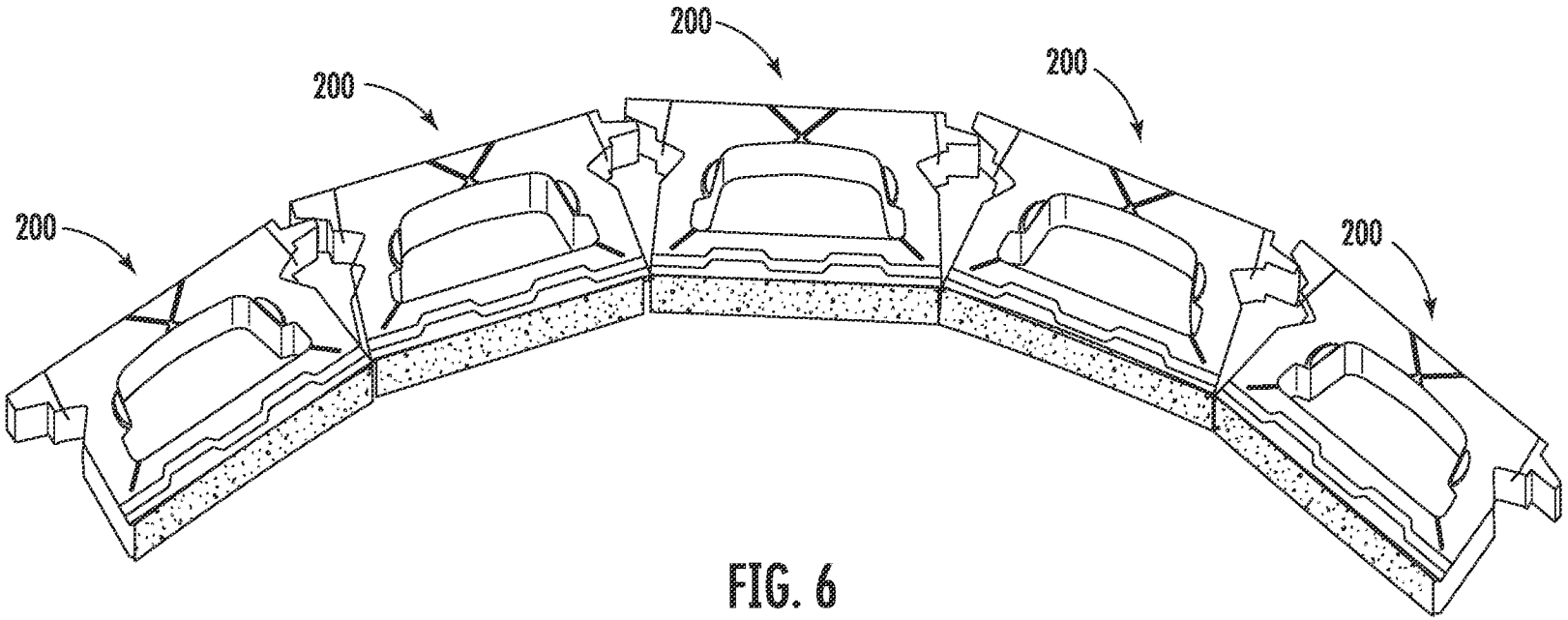
FIG. 6 illustrates a plan view of several of the large masonry blocks arranged in a concave curve.

Referring to FIG. 6, a plan view of several of the large masonry blocks 200 arranged in a concave curve is shown. In this configuration, the large masonry block legs 210 of the large masonry blocks 200 are left intact and only the side edges near the large masonry block front 204 touch and impart friction against each other. Although, in this configuration, there is minimum friction between adjacent large masonry blocks 200, it is difficult for such large masonry blocks 200 to be moved by soil pressure due to the concave arrangement of the large masonry blocks 200 and further by interaction between the large masonry block legs 210.

Figure 7:
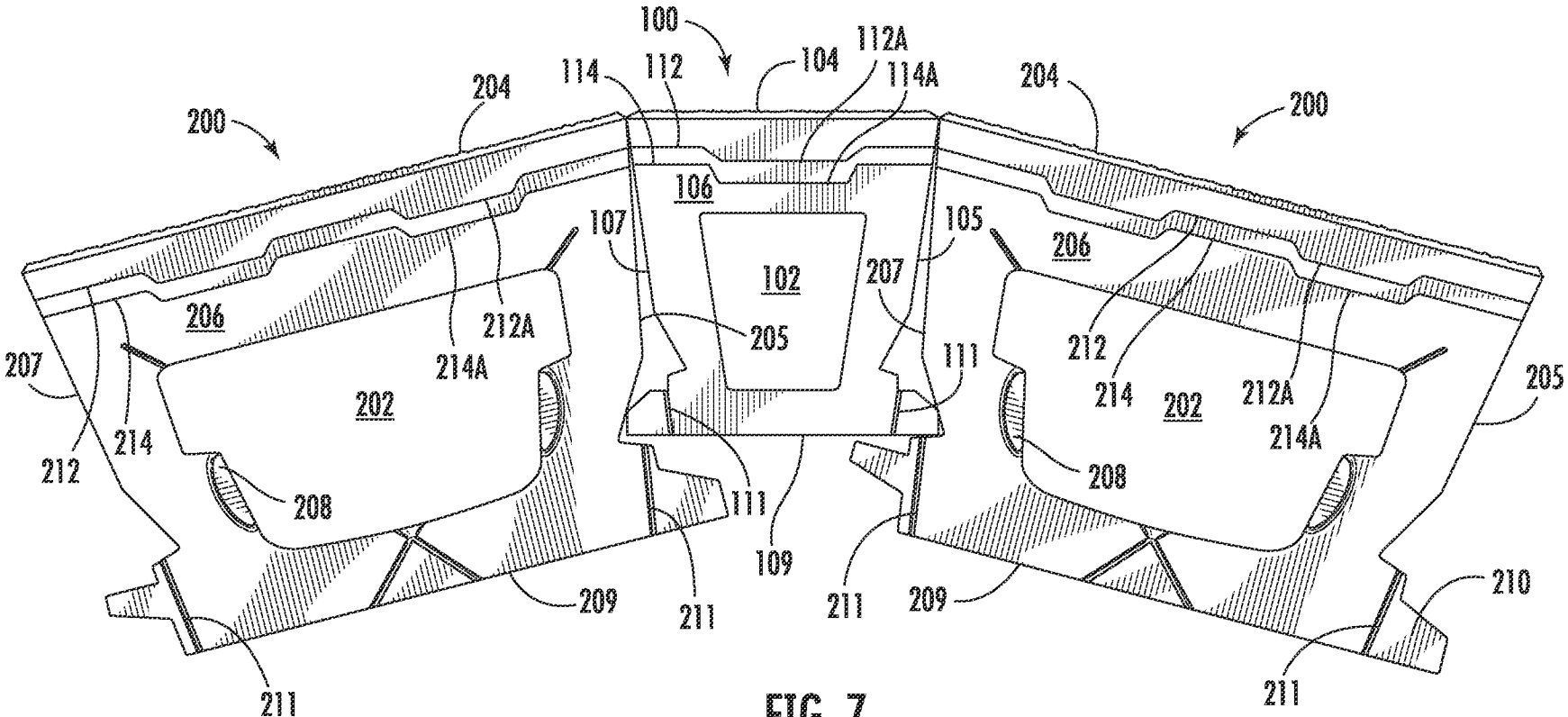
FIG. 7 illustrates a plan view of alternating of the large masonry blocks with small masonry blocks arranged in a convex curve.

Referring to FIG. 7, a plan view of alternating of the large masonry blocks 200 with small masonry blocks 100 arranged in a convex curve is shown. In this view, a smaller radius convex curved wall is formed by alternating of large masonry blocks 200 with small masonry blocks 100. Note how the small masonry block legs 110 rest within the large masonry block inset 218. This aligns the small masonry block 100 with the adjacent large masonry blocks 200 and prevents the small masonry block 100 from being pushed out from between the adjacent large masonry blocks 200 by pressure from materials behind this convex wall.

Figure 8:
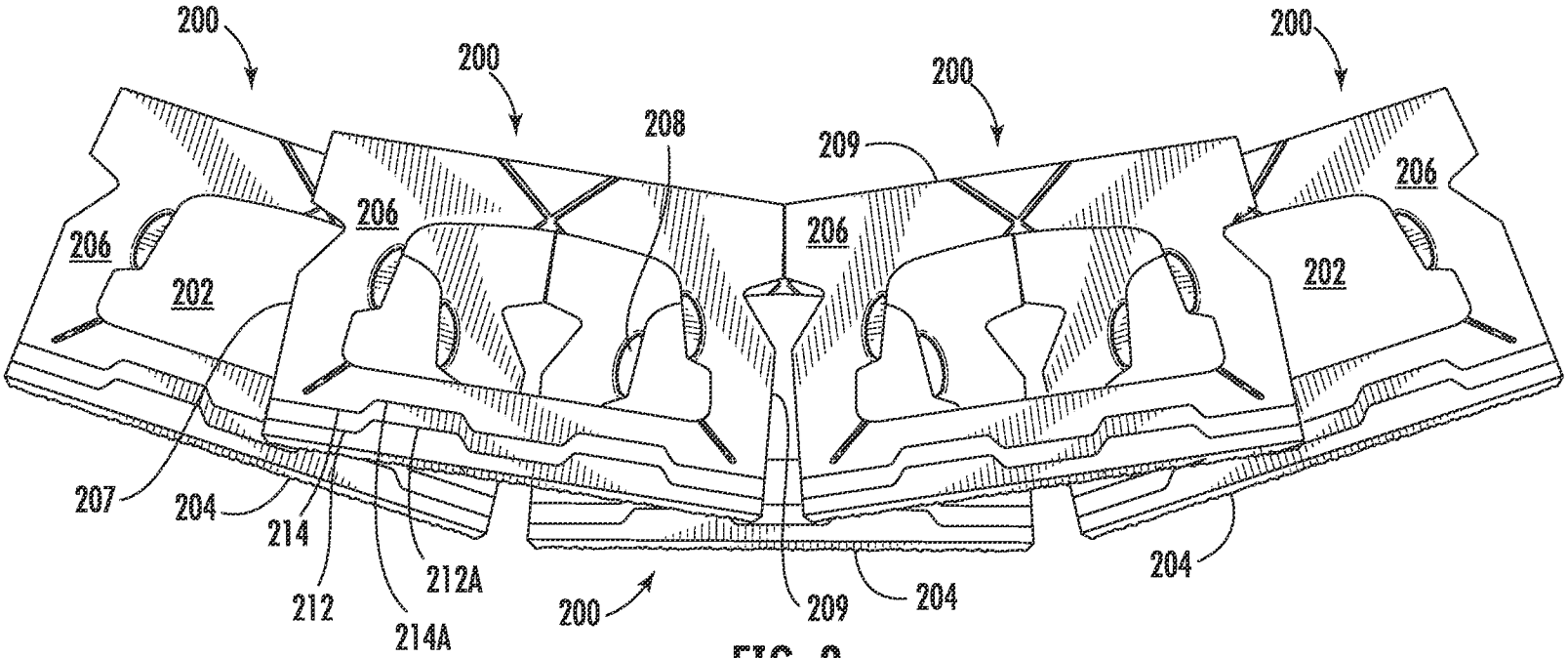
FIG. 8 illustrates a plan view of overlapping layers of large masonry blocks arranged in a convex curve.

Referring to FIG. 8, a plan view of overlapping layers of large masonry blocks 200 arranged in a convex curve is shown. Note, in this example, the large masonry block legs 210 remain intact and touch while the side edges of the large masonry block 200 near the large masonry block front 204 are set slightly apart.

This pattern of large masonry blocks 200 takes advantage of staggering of the large masonry block steps 212/214/212A/214A. When there are multiple layers of masonry blocks 100/200 set at an angle to each other, the large masonry block notches 222/224 of the large masonry blocks 200 of an upper layer of the large masonry blocks 200 interface both with the outer large masonry block steps 212/214 and inner large masonry block steps 212A/214A. This provides improved structural strength as well as guides for setting each layer at a similar angle with respect to the next lower layer of the large masonry blocks 200. Note the same principle is present in the small masonry blocks 100 having outer small masonry block steps 112/114 and inner small masonry block steps 112A/114A (see FIG. 1).

It is anticipated that during construction, as for example in the landscape structure or wall such shown in FIG. 8, the structure or wall is generally constructed one layer at a time. Each layer of the masonry blocks 100/200 are set on top of subsequent lower layers of masonry blocks 100/200 such that the masonry block steps 112/114/112A/114A/212/214/212A/214A of the lower (prior) layer of masonry blocks 100/200 interface with the masonry block notches 122/124/222/224 of the layer of masonry blocks 100/200 that are being set. This provides a positive connection between layers. Since the masonry block steps 112/114/112A/114A/212/214/212A/214A of the prior layer of masonry blocks 100/200 are elevated with respect to the masonry block top surface 106/206, the layer of masonry blocks 100/200 that are being set are unable to be pushed forward beyond where the masonry block notches 122/124/222/224 touch/interface with the masonry block steps 112/114/112A/114A/212/214/212A/214A, forcing setting of this layer of masonry blocks 100/200 at the correct setback and preventing each subsequent layer of masonry blocks 100/200 from being pushed forward by sheer forces coming from the material being retained by the wall/structure.

In such, the masonry block steps 112/114/112A/114A/212/214/212A/214A are setback from a front top edge of the masonry blocks 100/200 by a first setback distance and the masonry block notches 122/124/222/224 are setback from a front bottom edge by a second setback distance that is less than the first setback distance. In this way, the overall setback of a construction (e.g., wall) made of such masonry blocks 100/200 is defined by the difference between the first setback distance and the second setback distance. For example, if the first setback distance is two-inches and the second setback distance is five-inches, the each subsequently higher layer of the masonry blocks 100/200 will be setback three-inches from the base layer of the masonry blocks 100/200 (assuming proper installation in which the masonry block steps 112/114/112A/114A/212/214/212A/214A interface/abut the masonry block notches 122/124/222/224).

The number of masonry block steps 112/114/112A/114A/212/214/212A/214A is shown as two as is the number of the masonry block notches 122/124/222/224, though any number of steps and notches is anticipated, including one step and one notch. It is preferred that the number of steps equals the number of notches, though not required.

In some embodiments, after each layer of masonry blocks 100/200 are set, the appropriate fill is placed behind the wall as well as the appropriate fill used to fill the masonry block openings 102/202 such as rock, stone, gravel, and/or concrete. Once complete, pressure on the structure or wall from behind the wall (material that is to be retained by the wall) tend to force the masonry blocks 100/200 of each subsequently higher layer outward towards the front of the wall. The interface between the masonry block steps 112/114/112A/114A/212/214/212A/214A and the masonry block notches 122/124/222/224, along with friction between touching surfaces of the masonry blocks 100/200 resist the movement between the masonry blocks 100/200. It is fully intended that the structure/wall be formed using masonry blocks 100/200 without the use of mortar, though the use of mortar is not precluded. It is also anticipated that after setting each layer of the masonry blocks 100/200, a layer of geogrid is placed over the layer of masonry blocks 100/200, extending behind the masonry blocks 100/200 to be covered with fill as the fill is placed behind the wall/structure after each layer of the masonry blocks 100/200 are set.

Figure 9:
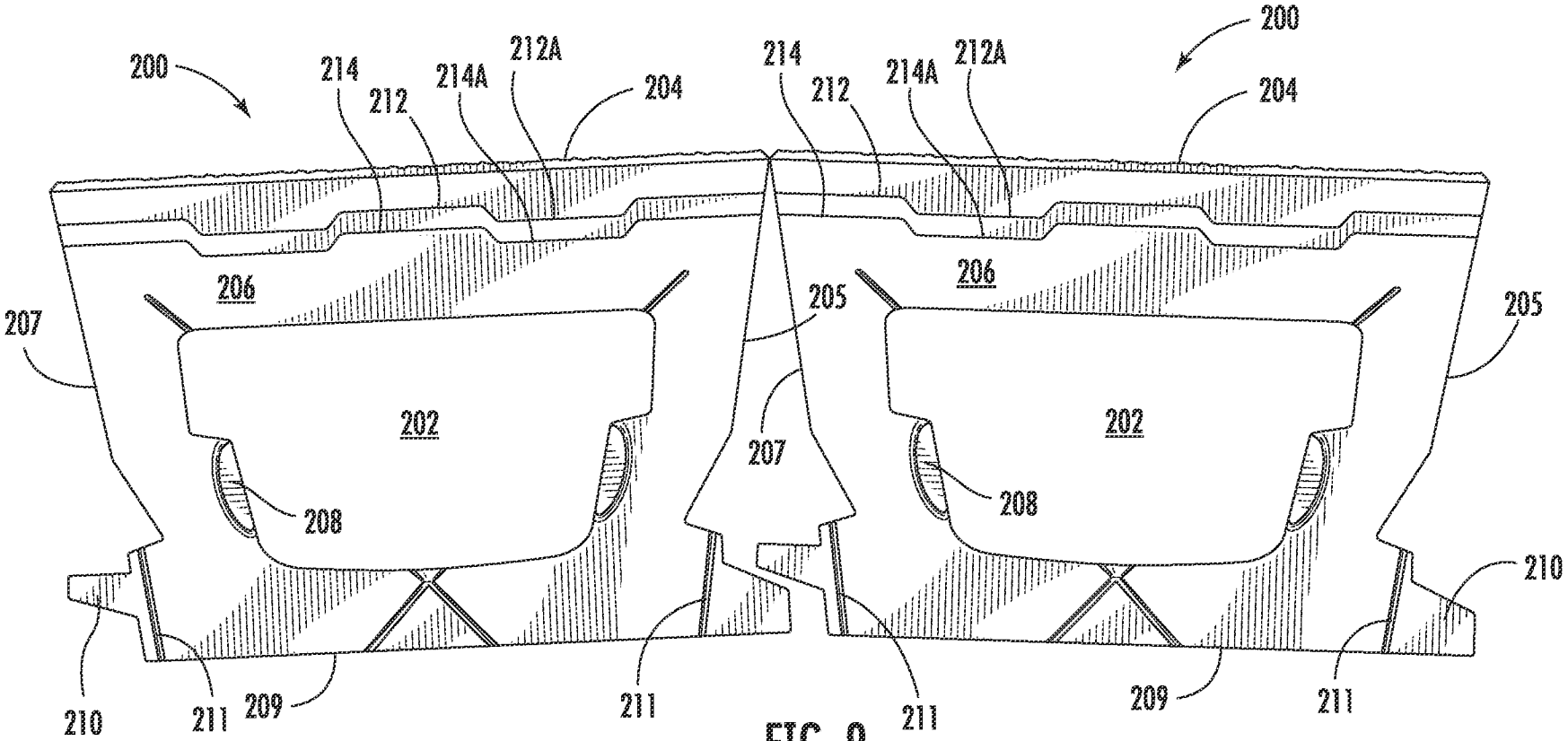
FIG. 9 illustrates a plan view of large masonry blocks arranged in a convex curve.
Figure 10:
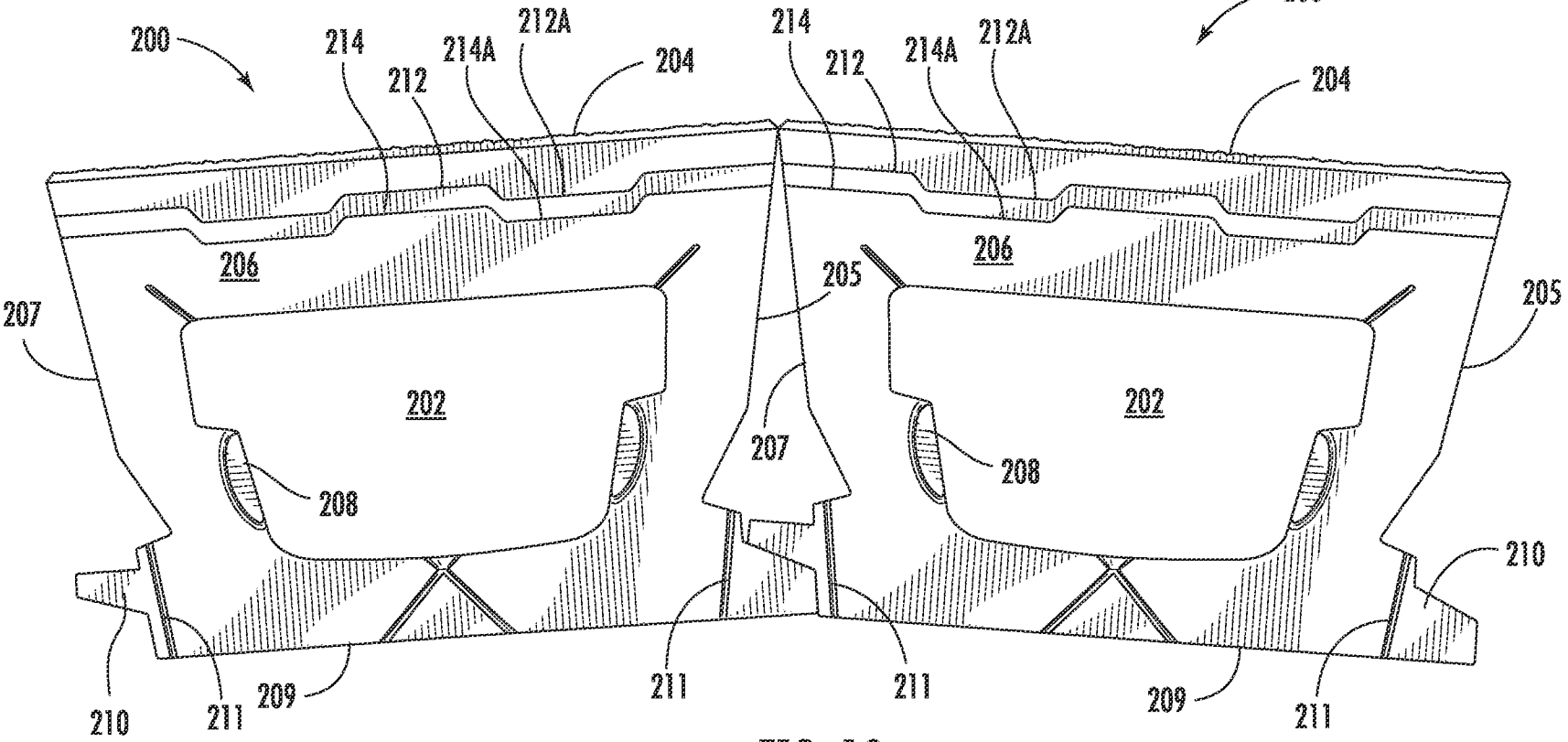
FIG. 10 illustrates a closeup plan view of the interface between the large masonry blocks arranged in a convex curve.

Referring to FIGS. 9 and 10, plan views of large masonry blocks 200 arranged in a convex curve are shown. In FIG. 9, the large masonry block legs 210 fully overlap and touch forming a concave wall with a slight convex curvature while in FIG. 10, the large masonry block legs 210 are set slightly apart forming a concave wall with a convex curvature that has a larger radius than that of the concave wall of FIG. 9.

Figure 11:
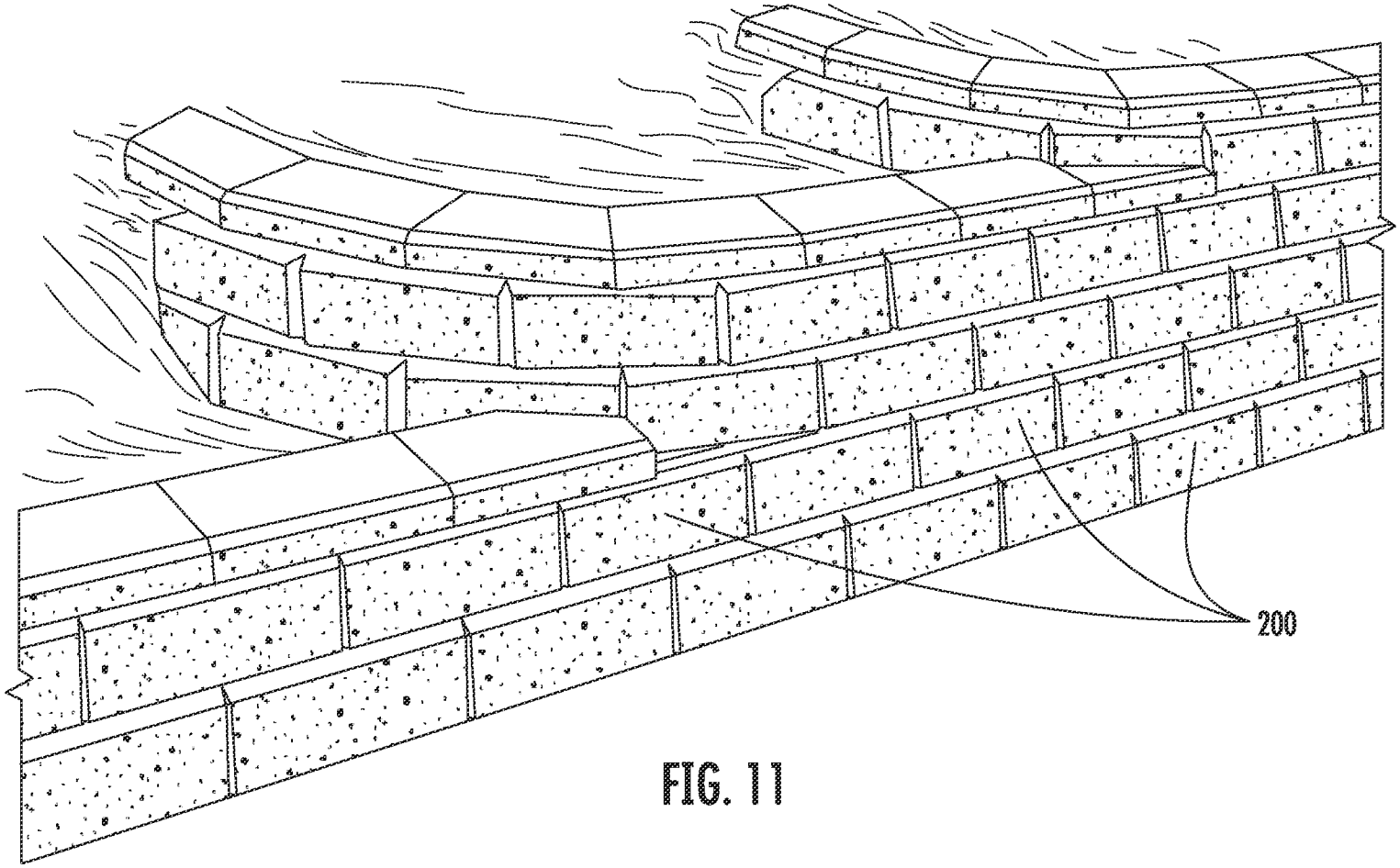
FIG. 11 illustrates a perspective view of a wall having multiple radii formed with the large masonry blocks.

Referring to FIG. 11, a perspective view of a wall having multiple radii formed with the large masonry blocks 200 is shown. Note that, for aesthetic reasons, planar caps are affixed to the upper-most layer of the large masonry blocks 200, as known in the business.

Figure 12:
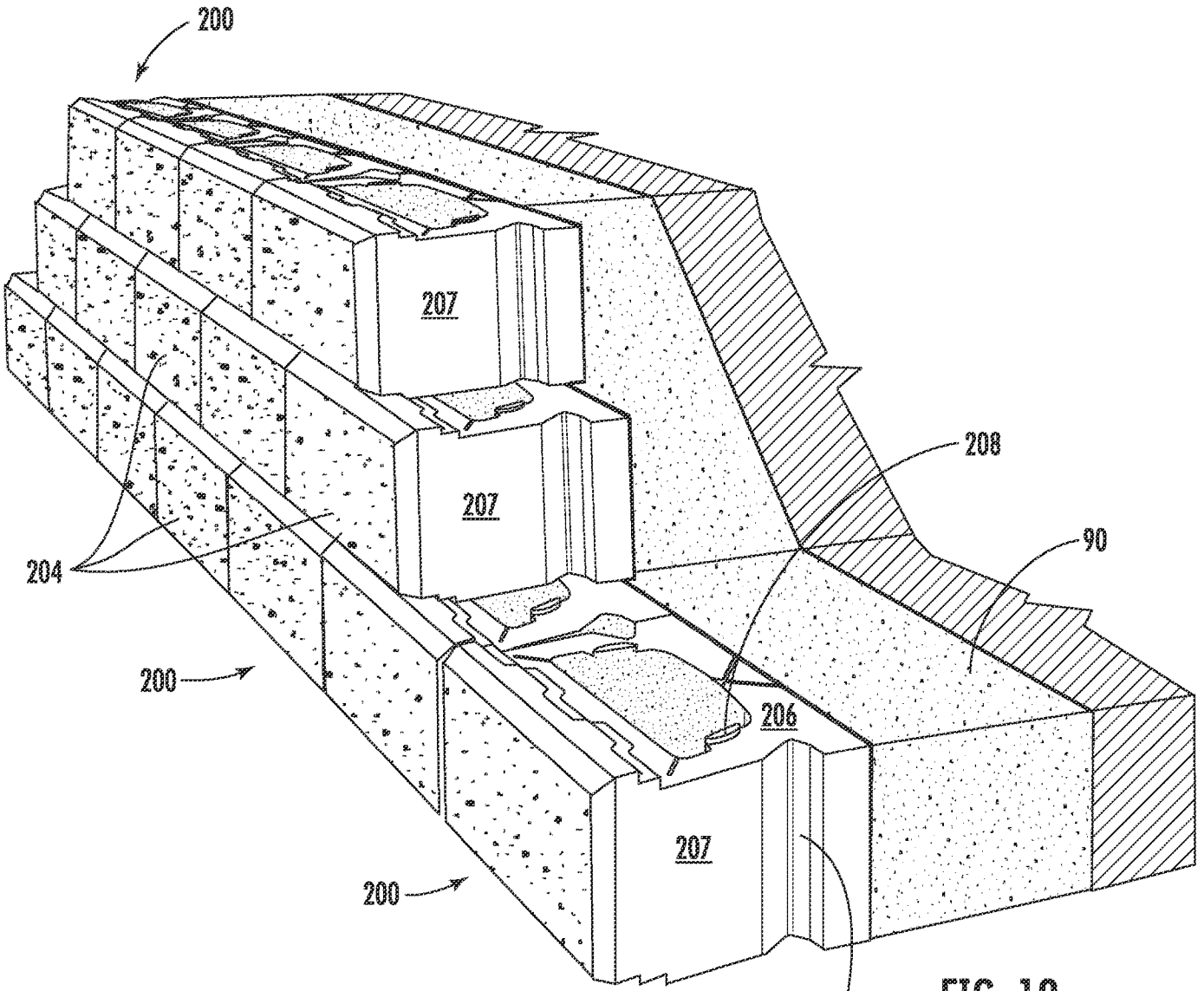
FIG. 12 illustrates a perspective cut-away view of a linear wall made of the large masonry blocks.

Referring to FIG. 12, a perspective cut-away view of a linear wall made of the large masonry blocks 200 is shown. In this, the set back of subsequently higher layers of the large masonry blocks 200 is shown as the large masonry block steps 212/214/212A/214A of a lower layer of the large masonry blocks 200 mate with large masonry block notches 222/224 of a next-higher layer of the large masonry blocks 200. Although note shown in FIG. 12, it is fully anticipated to include a layer of geogrid between subsequent layer of the masonry blocks 100/200. In such, after each layer of masonry blocks 100/200 are set, an area behind the layer of the masonry blocks 100/200 is filled with dirt/rock 90 and the geogrid is laid across the layer of the masonry blocks 100/200, extending atop the dirt/rock 90, providing greater structural strength.

Note that, as shown in this example, distances between of the large masonry block steps 212/214/212A/214A and the large masonry block front 204 define a setback of subsequently higher layers of large masonry blocks 200. By adjusting the molds in the manufacturing process to vary the distances between of the large masonry block steps 212/214/212A/214A and the large masonry block front 204, different setbacks of subsequently higher layers of large masonry blocks 200 are achieved. The same holds true with the small masonry blocks. By adjusting the molds in the manufacturing process to vary the distances between of the small masonry block steps 112/114/112A/114A and the small masonry block front 104, different setbacks of subsequently higher layers of small masonry blocks 100 are achieved. Likewise, the same holds true for walls made of combinations of small masonry blocks 100 and large masonry blocks 200. It is also anticipated that the masonry block notches 122/124/222/224 be adjusted in the same way during the molding/fabricating process. Therefore, for example using the large masonry blocks 200, the setback is determined by the difference between the depth of the step-setback (e.g. the distances between of the large masonry block steps 212/214/212A/214A and the large masonry block front 204) and the notch-setback (e.g. the distances between of the large masonry block notches 222/224 and the large masonry block front 204). The same holds true for the small masonry block 100. If the step-setback is two inches and the notch-setback is one inch, then each subsequent layer of the masonry blocks 100/200 will be setback one inch from the next lower layer of the masonry blocks 100/200. The masonry blocks 100/200 are typically designed for a three-degree to twelve-degree setback.

Figure 13:
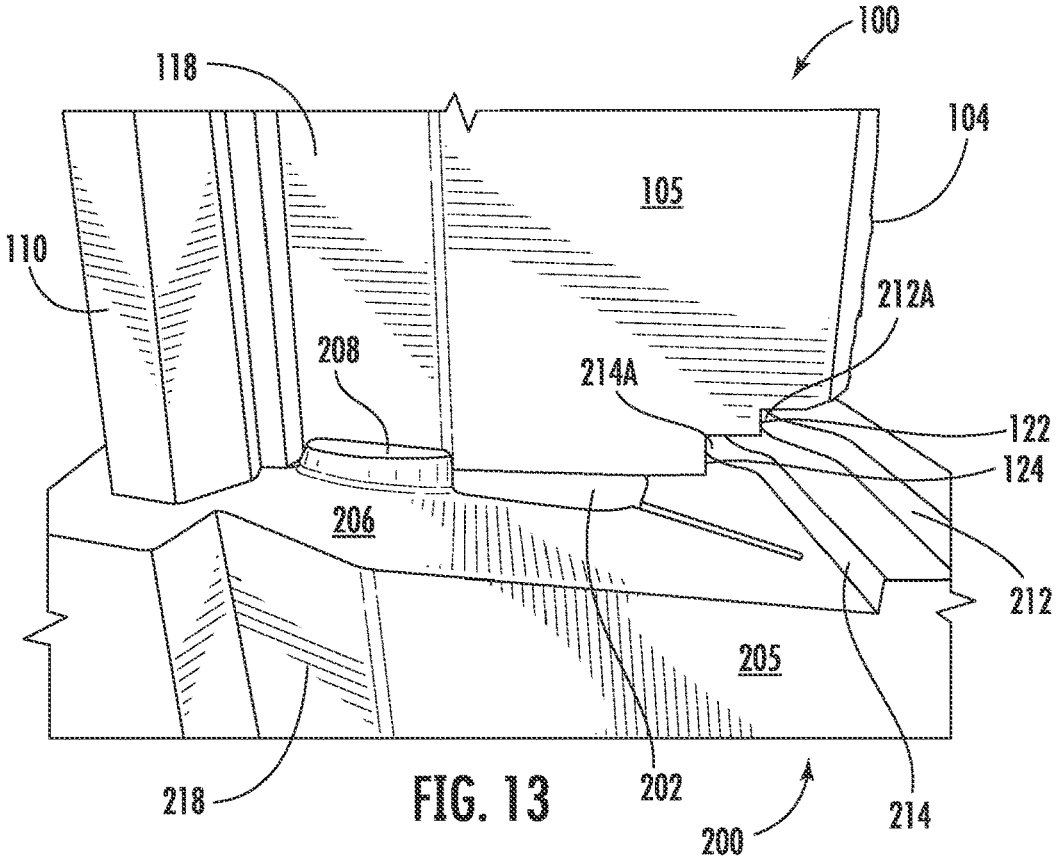
FIG. 13 illustrates a side view of stacking of large masonry blocks.
Figure 14:
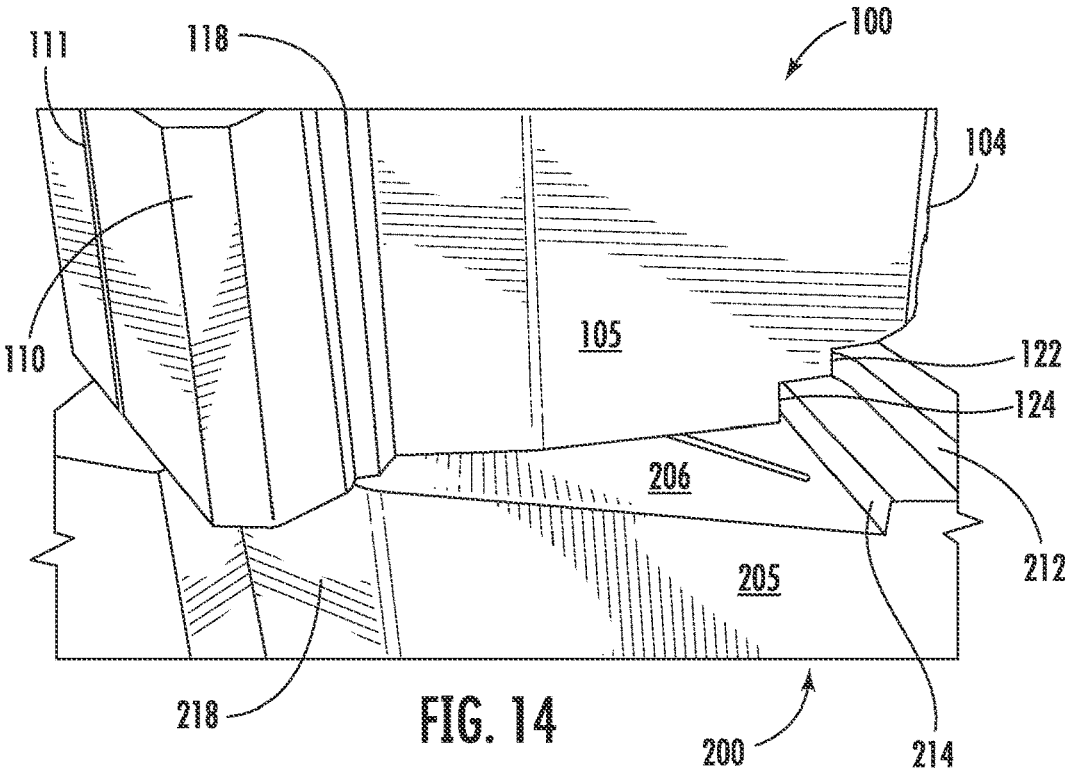
FIG. 14 illustrates a side view of stacking of large masonry blocks in a convex curve.

Referring to FIGS. 13 and 14, side view of stacking of masonry blocks 100/200 are shown. In FIG. 13, the small masonry block 100 is at a minimal angle with respect to the large masonry block 200 and, therefore, the small masonry block notches 122/124 abut against the back-most large masonry block steps 212A/214A (furthest steps from the large masonry block front 204) and the large masonry block key 208 locks into the small masonry block inset 118. In FIG. 14, the small masonry block 100 is at an angle with respect to the large masonry block 200 and, therefore, the small masonry block notches 122/124 abut against outer large masonry block steps 212/214 and the large masonry block key 208 is not visible but located within the small masonry block opening 102. Note that the small masonry block notches 122/124 also abut against the inner large masonry block steps 212A/214A which is not visible in FIG. 14.

Figure 15:
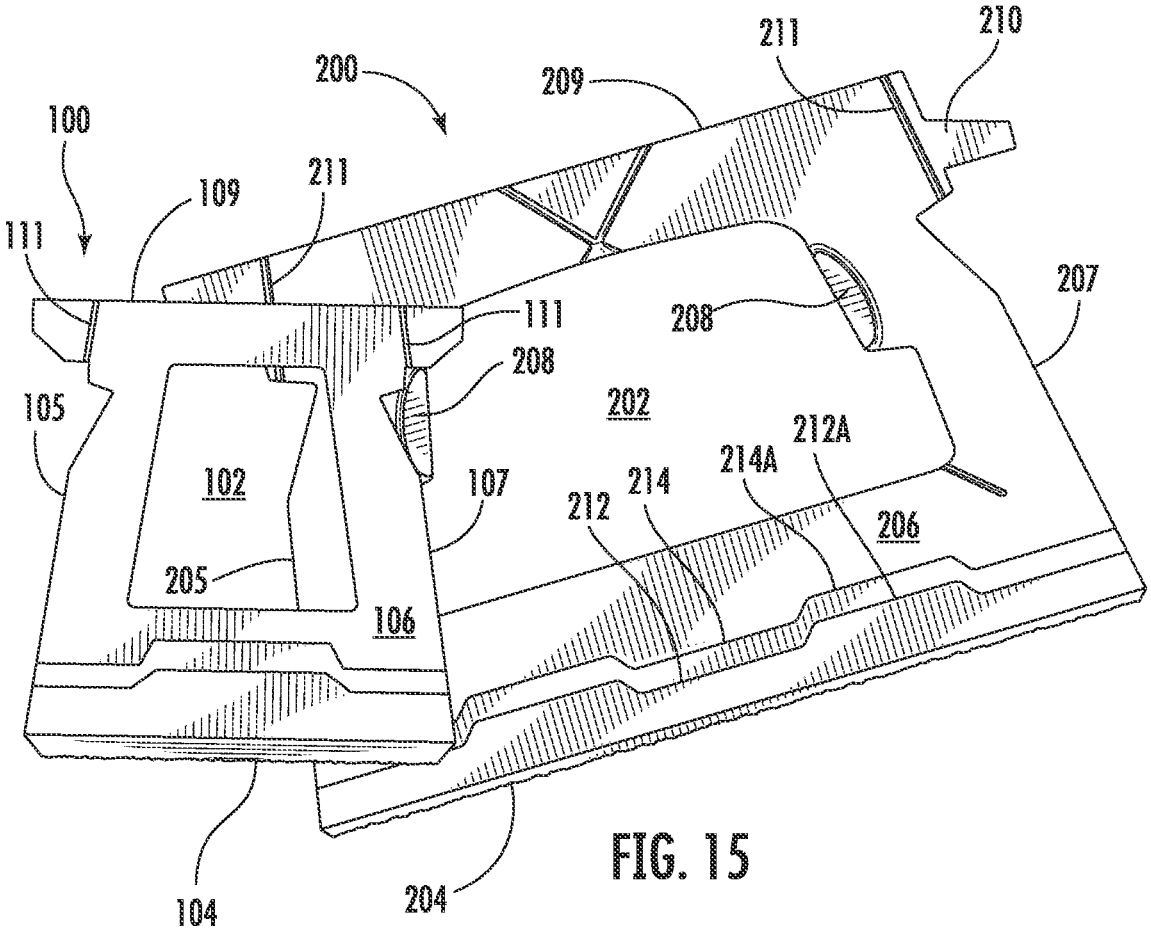
FIG. 15 illustrates a plan view of stacking of a small masonry block atop a large concrete block.
Figure 16:
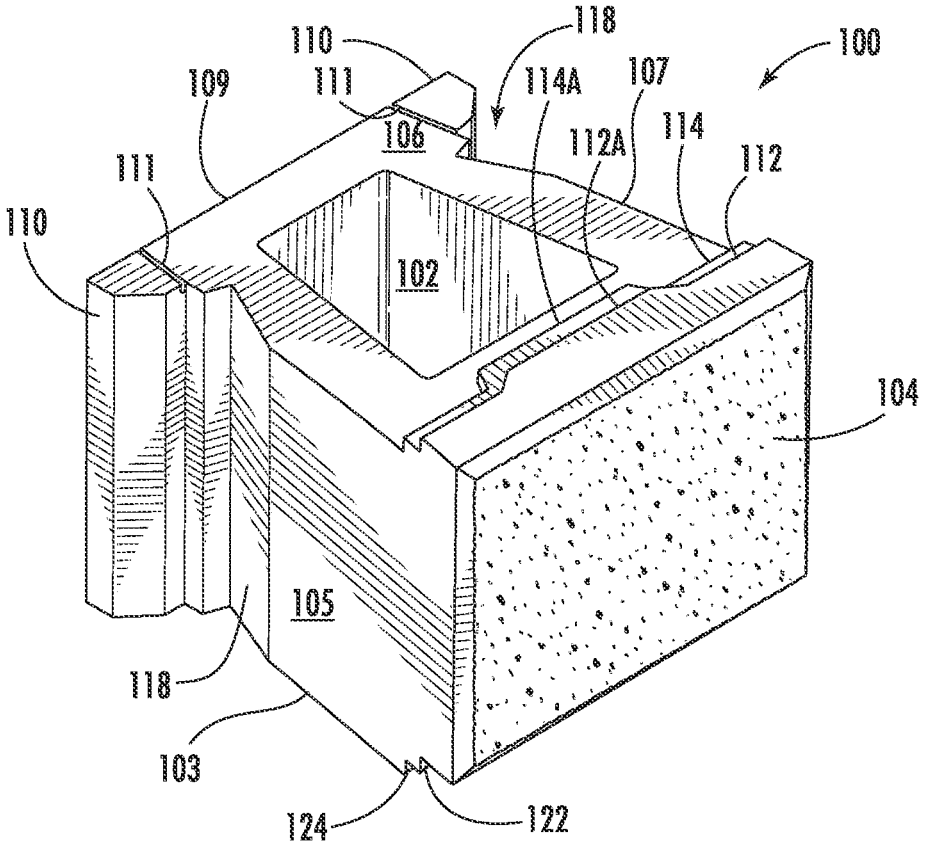
FIG. 16 illustrates a perspective view of a small masonry block.
Figure 17:
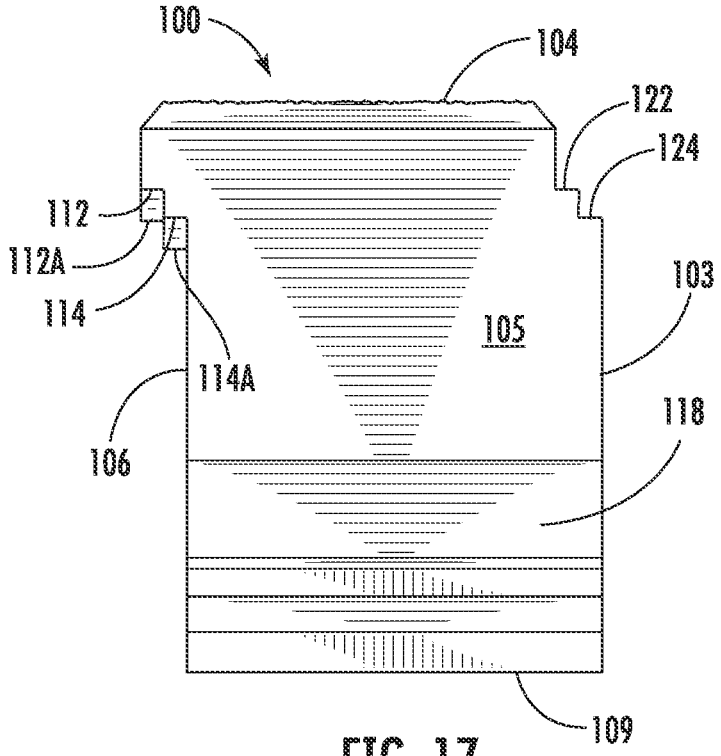
FIG. 17 illustrates a elevational view of the small masonry block.
Figure 18:
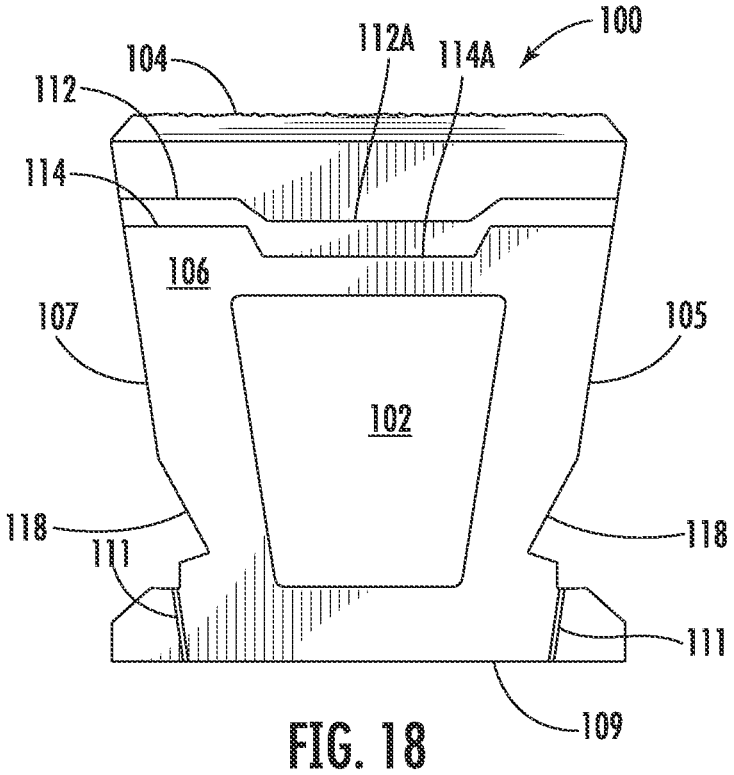
FIG. 18 illustrates a top plan view of the small masonry block.
Figure 19:
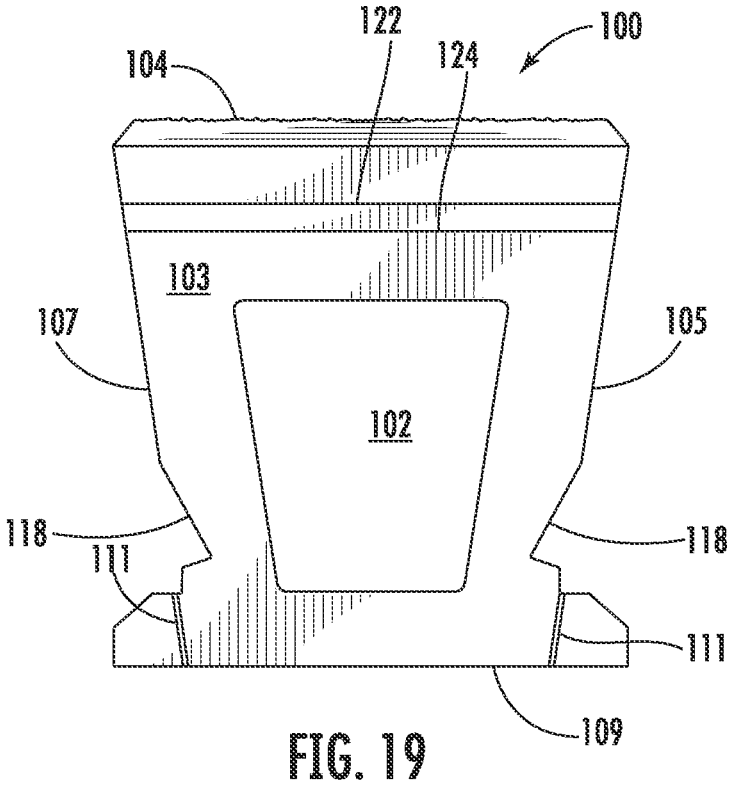
FIG. 19 illustrates a bottom plan view of the small masonry block.
Figure 20:
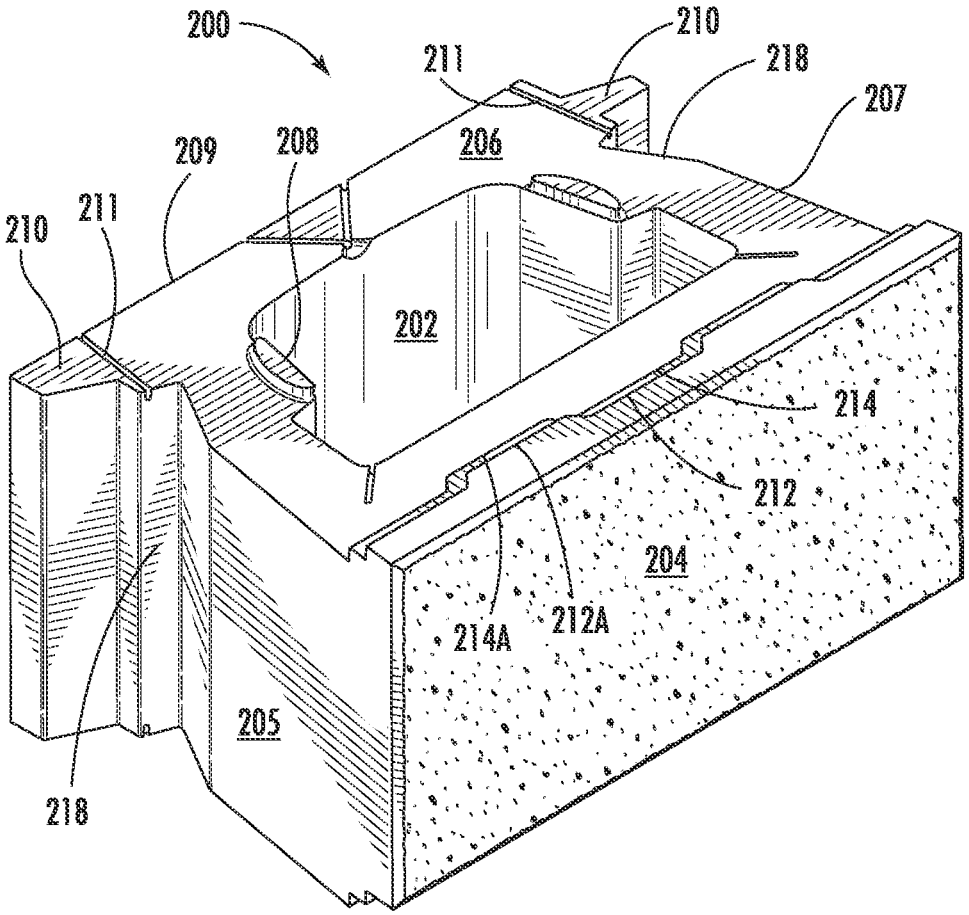
FIG. 20 illustrates a top perspective view of the large masonry block.
Figure 21:
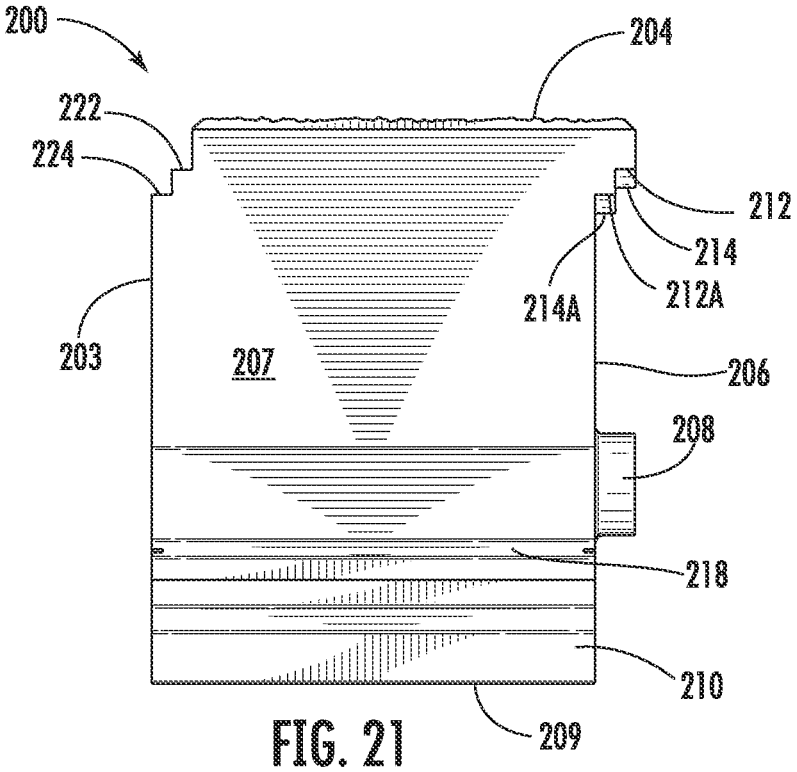
FIG. 21 illustrates a side elevational view of the large masonry block.
Figure 22:
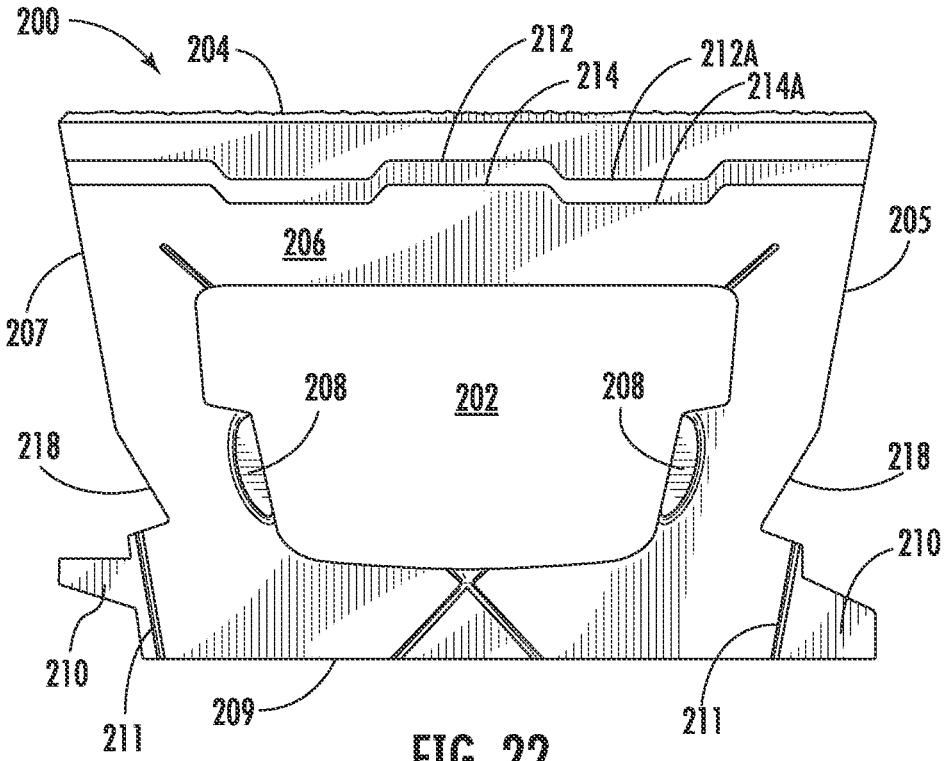
FIG. 22 illustrates a top plan view of the large masonry block.
Figure 23:
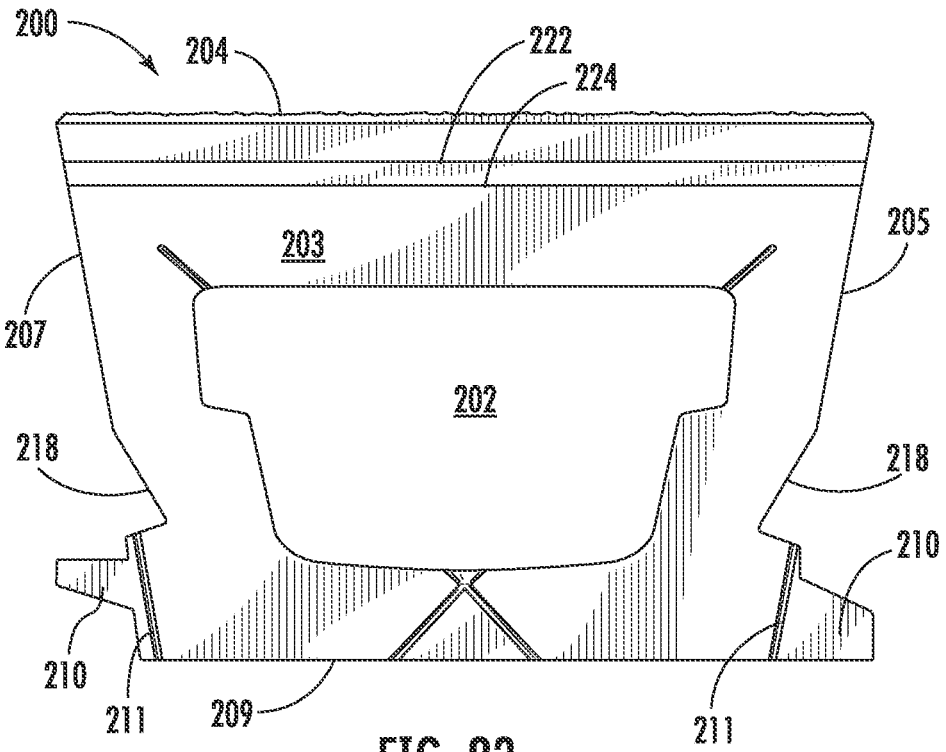
FIG. 23 illustrates a bottom plan view of the large masonry block.

Referring to FIG. 15, a plan view of stacking of a small masonry block 100 atop a large masonry block 200 is shown. The large masonry block key 208 locks into the small masonry block inset 118 and the small masonry block notches 122/124 (not visible) interface with the outer large masonry block steps 212/214.

Referring to FIGS. 16, 17, 18, and 19 views of the small masonry block 100 are shown. The small masonry block 100 has a small masonry block front 104 (the face part that is visible when built into a wall) with small masonry block sides 105/107. Each of the small masonry block sides 105/107 have small masonry block insets 118 and small masonry block legs 110. There is a small masonry block opening 102, the purpose of such is for reducing the total weight of the small masonry block 100.

The small masonry block top surface 106 has small masonry block steps 112/114/112A/114A and the small masonry block bottom surface 103 has small masonry block notches 122/124.

As another masonry block 100/200 is stacked over a small masonry block 100, the small masonry block steps 112/114/112A/114A of the small masonry block 100 mate with the notches (small masonry block notches 122/124 or large masonry block notches 222/224) of the other masonry block 100/200. Likewise, as the small masonry block 100 is stacked upon another masonry block 100/200, the small masonry block notches 122/124 of that small masonry block 100 mates with the steps (small masonry block steps 112/114/112A/114A or large masonry block steps 212/214/212A/214A) if the other masonry block 100/200. This mating helps make sure that the proper setback is made (note the forced setback shown in FIG. 1) and also provides structural support keeping upper layers of the masonry blocks 100/200 from being pushed out with respect to lower layers of the masonry blocks 100/200.

The small masonry block back surface 109 interfaces with whatever material is filled behind the constructed wall. Note that in some installations, after each layer of the masonry blocks 100/200 are stacked, the small masonry block opening 102 is filled with material such as rock, stone, pebbles, dirt, and sand.

In some embodiments, the small masonry block legs 110 have score lines 111 for knocking off the small masonry block legs 110 in a predictable way with a simple tool such as a hammer and chisel.

Referring to FIGS. 20, 21, 22, and 23, views of the large masonry block 200 are shown. The large masonry block 200 has a large masonry block front 204 (the face part that is visible when built into a wall) with large masonry block sides 205/207, and a large masonry block back surface 203. Each of the large masonry block sides 205/207 have large masonry block insets 218 and large masonry block legs 210. There is a large masonry block opening 202, the purpose of such is for reducing the total weight of the large masonry block 200.

Each large masonry block 200 has two large masonry block keys 208 on the large masonry block top surface 206. The large masonry block keys 208 provide reference points during installation. As the masonry blocks 100/200 are stacked to create walls, the large masonry block keys 208 provide such reference points to produce walls that are regular and symmetrical. In some installations, the large masonry block keys 208 rest against the side of the masonry block 100/200 that is placed on top of the large masonry block 200, thereby providing extra resistance from movement of the masonry blocks 100/200 with respect to each other. Further, in installations in which a geogrid is placed between successive layers of the masonry blocks 100/200, the large masonry block keys 208 prevent the geogrid sheets from sliding out during construction and during the life of the resulting wall.

The large masonry block keys 208 have another function. As the large masonry block steps 212/214/212A/214A are not level with the large masonry block top surface 206 of the large masonry block 200, the large masonry block keys 208 help keep stacks of large masonry blocks 200 somewhat level for storage and shipment.

As another masonry block 100/200 is stacked over a large masonry block 200, the large masonry block steps 212/214/212A/214A of the large masonry block 200 mate with the notches (small masonry block notches 122/124 or large masonry block notches 222/224) of the other masonry block 100/200. Likewise, as the large masonry block 200 is stacked upon another masonry block 100/200, the large masonry block notches 222/224 of that large masonry block mates with the steps (small masonry block steps 112/114/112A/114A or large masonry block steps 212/214/212A/214A) if the other masonry block 100/200. This mating helps make sure that the proper setback is made (note the forced setback shown in FIG. 1) and also provides structural support keeping upper layers of the masonry blocks 100/200 from being pushed out with respect to lower layers of the masonry blocks 100/200.

The back surface 209 of the large masonry block 200 interfaces with whatever materials are held behind the constructed wall. Note that in some installations, after each layer of the masonry blocks 100/200 are stacked, the masonry block openings 102/202 is/are filled with material such as rock, stone, pebbles, dirt, and sand.

In some embodiments, the large masonry block legs 210 have score lines 211 for knocking off the large masonry block legs 210 in a predictable way with a simple tool such as a hammer and chisel.

Figure 24:
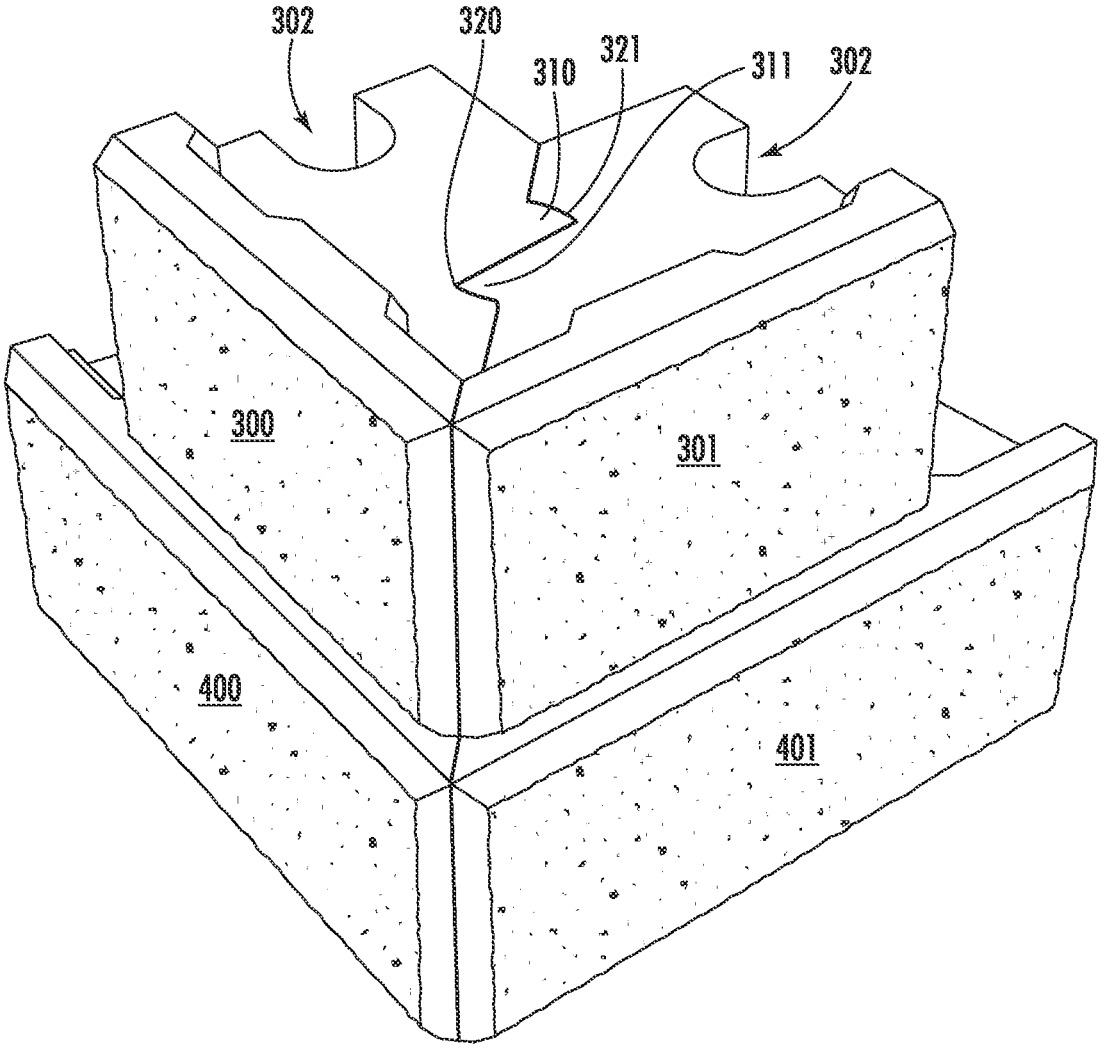
FIG. 24 illustrates a perspective view of two small corner masonry blocks positioned atop two large corner masonry blocks.

Referring to FIG. 24, a perspective view of two small corner masonry blocks 300/301 positioned atop two large corner masonry blocks 400/401 is shown. Note that there is a left small corner masonry block 300 and a right small corner masonry block 301. This is needed as the angled edge of the left small corner masonry block 300 is on a right side of the left small corner masonry block 300 and the angled edge of the right small corner masonry block 301 is on a left side of the right small corner masonry block 301. Note also that there is a left large corner masonry block 400 and a right large corner masonry block 401. As above, this is needed as the angled edge of the left large corner masonry block 400 is on a right side of the left large corner masonry block 400 and the angled edge of the right large corner masonry block 401 is on a left side of the right large corner masonry block 401.

In some embodiment, the corner masonry blocks 300/301/400/401 stack atop of each other with any desired setback while in some embodiments, the corner masonry blocks 300/301/400/401 include both small masonry block steps 112/114 or large masonry block steps 212/214 and small masonry block notches 122/124 or large masonry block notches 222/224 that function to provide a fixed setback in a similar manner to the small masonry blocks 100 and large masonry blocks 200. With such, the corner masonry blocks 300/301/400/401 will include the locking and setback features of the small masonry blocks 100 and large masonry blocks 200.

In some embodiments, a void 302/402 (see FIG. 26) is formed (respectively) in the corner masonry blocks 300/301/400/401. Any shape and size of void is fully anticipated, including tubular with a cross-sectional shape of a circle or flattened oval as shown in the drawings. In embodiments with the void 302/402, it is anticipated that during construction, material such as rock or rebar will be placed in the voids 302/402 to increase the structural performance of the corners of the wall.

Figure 28:
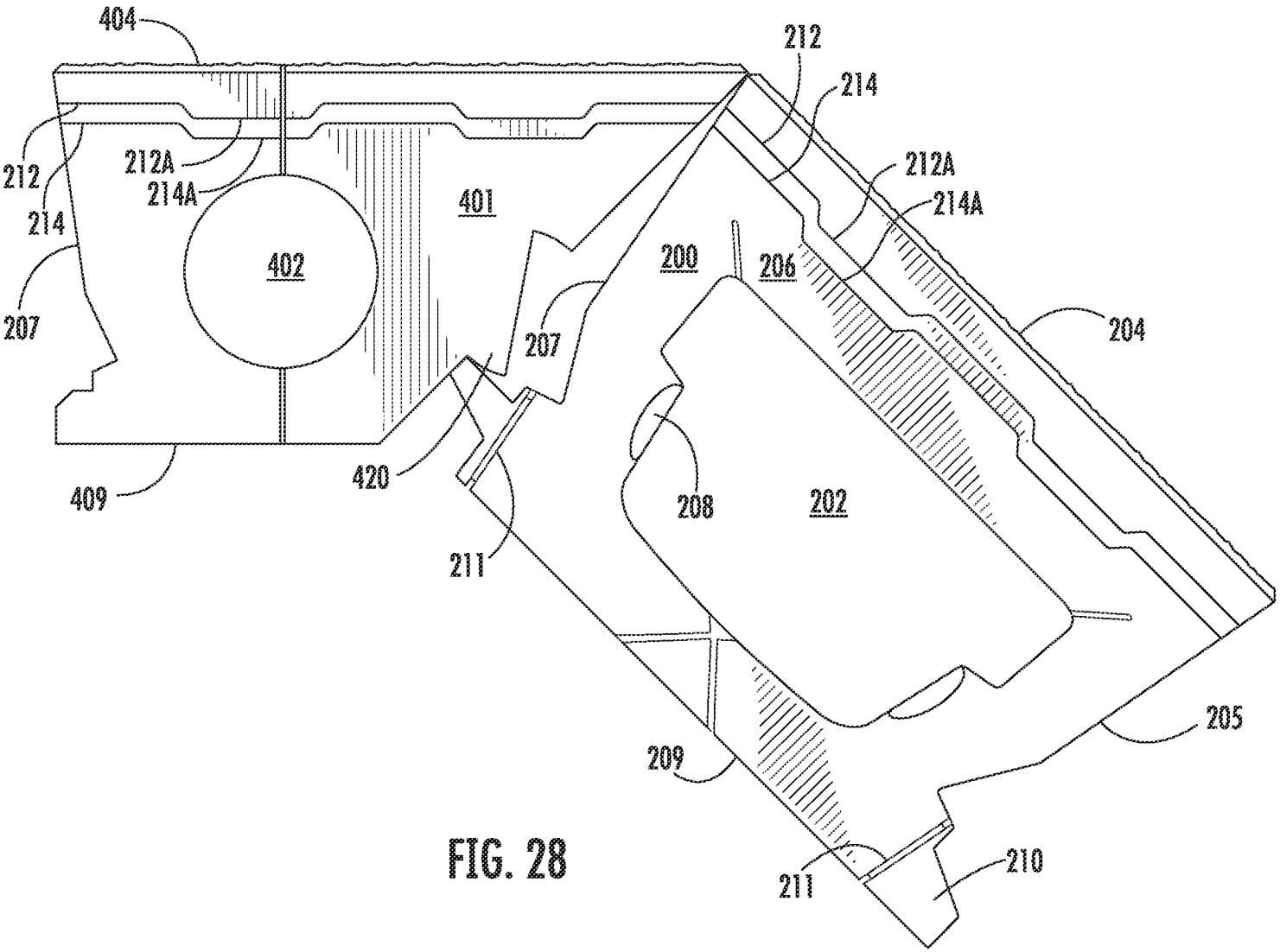
FIG. 28 illustrates a plan view of a connection between a large corner masonry block and a large masonry block forming an angle other than 90 degrees.

As pressure from behind the wall is exerted from moving earth and hydraulic pressure from accumulated water, the corner masonry blocks 300/301/400/401 have an interlock feature to reduce the wall failing at the seam where the corner masonry blocks 300/301/400/401 meet. This interlock feature includes first half interlock shown as a protrusion 310 on the left small corner masonry block 300 and a second half interlock shown as a receptacle 321 on the right small corner masonry block 301 (or vice versa). Likewise, there is second interlock shown as a protrusion 311 on the right small corner masonry block 301 and a receptacle 320 on the left small corner masonry block 300. Although this pair of protrusions 310/311 and pair of receptacles 320/321 are shown in a particulate shape, location, and size, there are no limitations as to shape, location, and size of the protrusions 310/311 and receptacles 320/321, though it is preferred that the protrusions 310/311 fit snuggly within the receptacles 320/321. Note that in some embodiments and usage scenarios, the placement and size of the protrusions 310/311 provide improved strength when a corner masonry block 300/400 mates with an adjacent small masonry block 100 or large masonry block 200, for example, as shown in FIG. 28.

In some embodiments, the small corner masonry blocks 300/301 are molded in the size and shape shown, with or without the voids 302. In some embodiments, the small corner masonry blocks 300/301 are made by breaking the large corner masonry blocks 400/401 along the score lines 430 (see FIG. 26). In such, the remaining section of the large corner masonry blocks 400/401 is then useful in other parts of the constructed wall.

It should be noted that, although the drawings show an angle 415 of approximately 45-degree where the left corner masonry blocks 300/400 meet the right corner masonry blocks 301/401, there is no restriction on this angle 415 as it is anticipated that other corner angles (e.g., other than 90 degrees) be fabricated by adjusting this angle 415 or having right angle corners in which the angle 415 is other than 45 degrees with asymmetrical angles. For example, the left corner masonry blocks 300/400 have an angle 415 of 40 degrees and the right corner masonry blocks 301/401 have an angle 415 of 50 degrees, still producing a 90-degree corner. Although shown forming a corner that is approximately 90 degrees, it is fully anticipated that the total of the angles 415 be other than 90 degrees. For example, to form a wall having hexagonal shape, the total angle is 120 degrees (e.g., the angle 415 of the left corner masonry block 300 has an angle 415 of 60 degrees and the angle 415 of the right corner masonry block 301 has an angle 415 of 60 degrees). Further, it is fully anticipated that the corner be at an angle greater than 90 degrees, for example for an inside corner that is 270 degrees (e.g., the angle of the left corner masonry blocks 300/400 have an angle 415 of 135 degrees and the right corner masonry blocks 301/401 have an angle 415 of 135 degrees).

Figure 25:
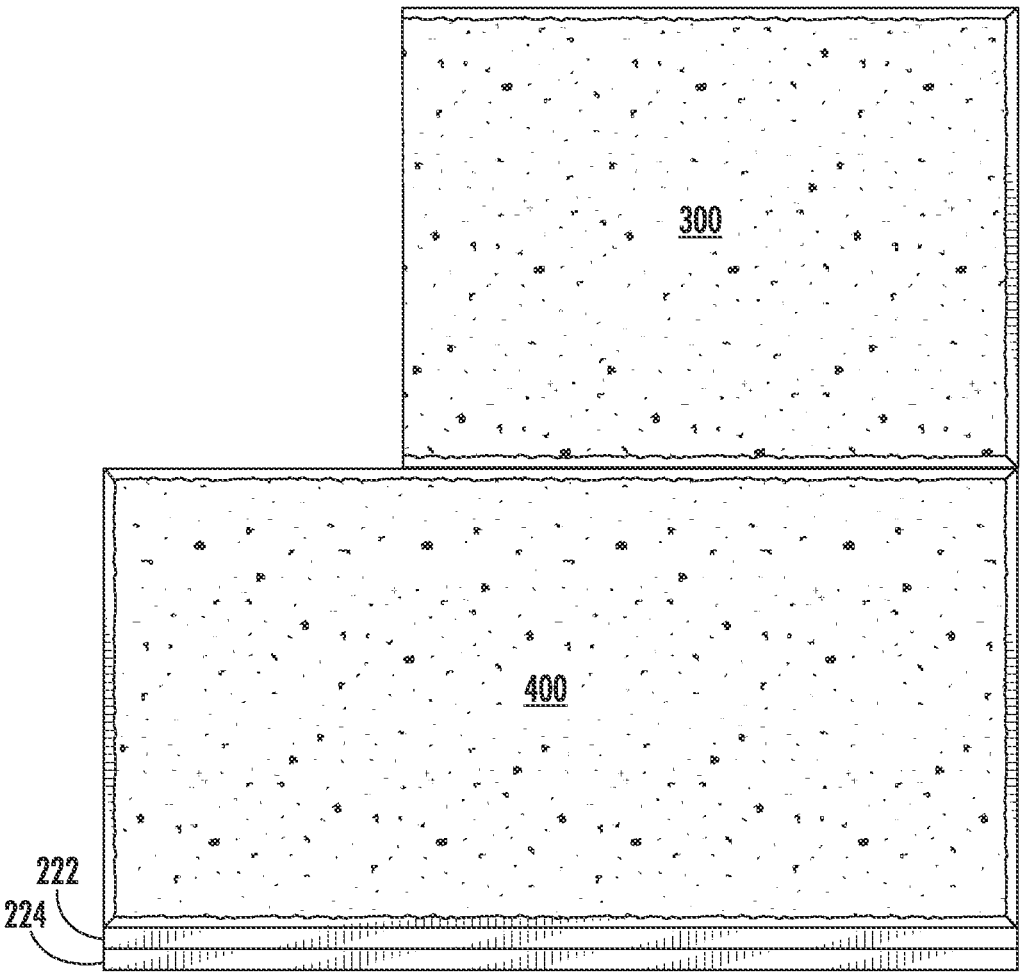
FIG. 25 illustrates an elevational view of a small corner masonry block positioned atop a large corner masonry block.

Referring to FIG. 25, an elevational view of small corner masonry blocks 300 positioned atop large corner masonry blocks 400 is shown. In this, the large masonry block notches 222/224 are visible, but the small masonry block notches 122/124 are not visible as the small masonry block notches 122/124 are engaged with the large masonry block steps 212/214 which are also not visible. have an interlock feature to reduce the wall failing at the seam where the corner masonry blocks 300/301/400/401 meet.

The large corner masonry blocks 400/410 also have the interlock feature. This interlock feature includes first half interlock shown as a protrusion 410 on the left large corner masonry block 400 and a second half interlock shown as a receptacle 421 on the right large corner masonry block 401 (or vice versa). Likewise, there is second interlock shown as a protrusion 411 on the right large corner masonry block 401 and a receptacle 420 on the left large corner masonry block 300. Although this pair of protrusions 410/411 and pair of receptacles 420/421 are shown in a particulate shape, location, and size, there are no limitations as to shape, location, and size of the protrusions 410/411 and receptacles 420/421, though it is preferred that the protrusions 410/411 fit snuggly within the receptacles 420/421. Note that in some embodiments and usage scenarios, the placement and size of the protrusions 410/411 provide improved strength when a corner masonry block 300/400 mates with an adjacent small masonry block 100 or large masonry block 200, for example, as shown in FIG. 28.

Figure 26:
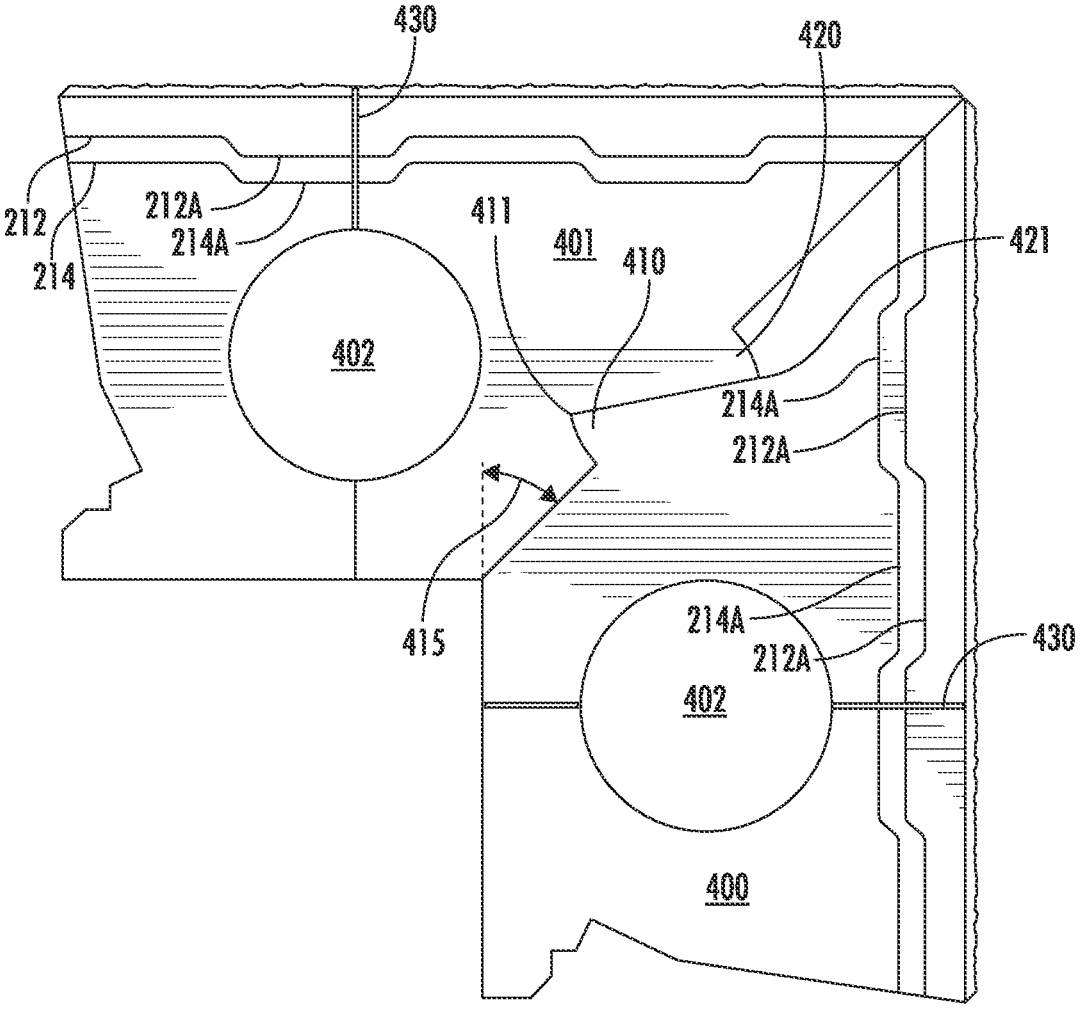
FIG. 26 illustrates a plan view of a connection between two large corner masonry blocks.

Referring to FIG. 26, a plan view of a connection between two large corner masonry blocks 400/401 is shown. In this view, the large masonry block steps 212/212A/214/214A are shown as well as the score lines 430 that are used to create small corner masonry blocks 300/301 from respective large corner masonry blocks 400/401 as discussed prior. Note that the large corner masonry block front surface 404 and the small corner masonry block front surface are of any surface texture known in the art, including rough (as shown), smooth, sculpted, formed to look like various stones or bricks, etc.

Figure 27:
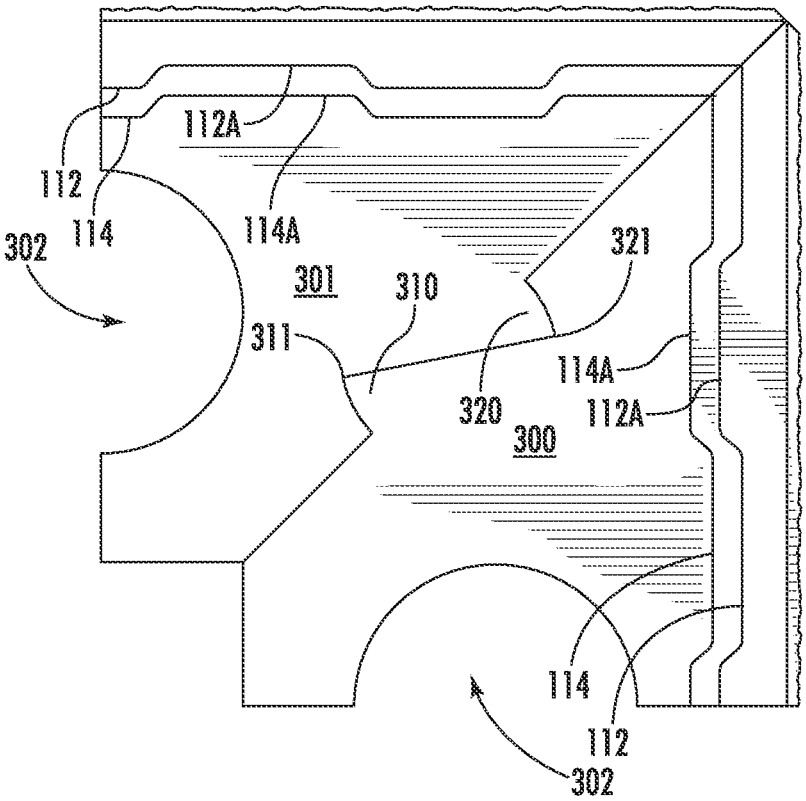
FIG. 27 illustrates a plan view of a connection between two small corner masonry blocks.

Referring to FIG. 27, a plan view of a connection between two small corner masonry blocks 300/301 is shown. In this view, the small masonry block steps 112/112A/114/114A are shown.

Referring to FIG. 28, a plan view of a connection between a right large corner masonry block 401 and a large masonry block 200 forming an angle other than 90 degrees is shown. Note that the large masonry block leg 210 of the large masonry block interlocks with the protrusion 411 of the right large corner masonry block 401, thereby providing increased resistance, reducing the ability of the large masonry block 200 from pushing forward.

Figure 29:
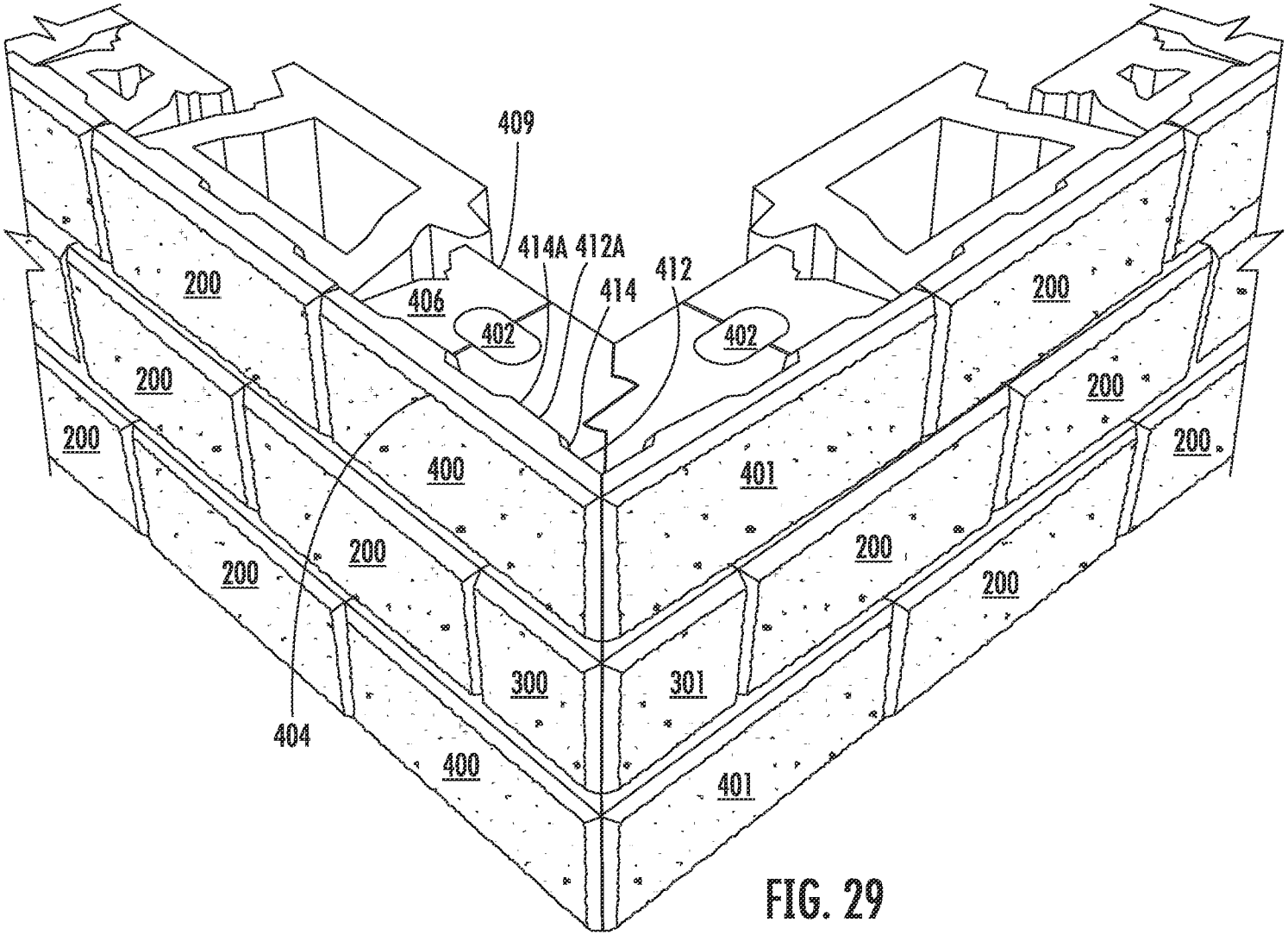
FIG. 29 illustrates a perspective view of a wall formed with small corner masonry blocks, small masonry blocks, two large corner masonry blocks, and large masonry blocks.
Figure 30:
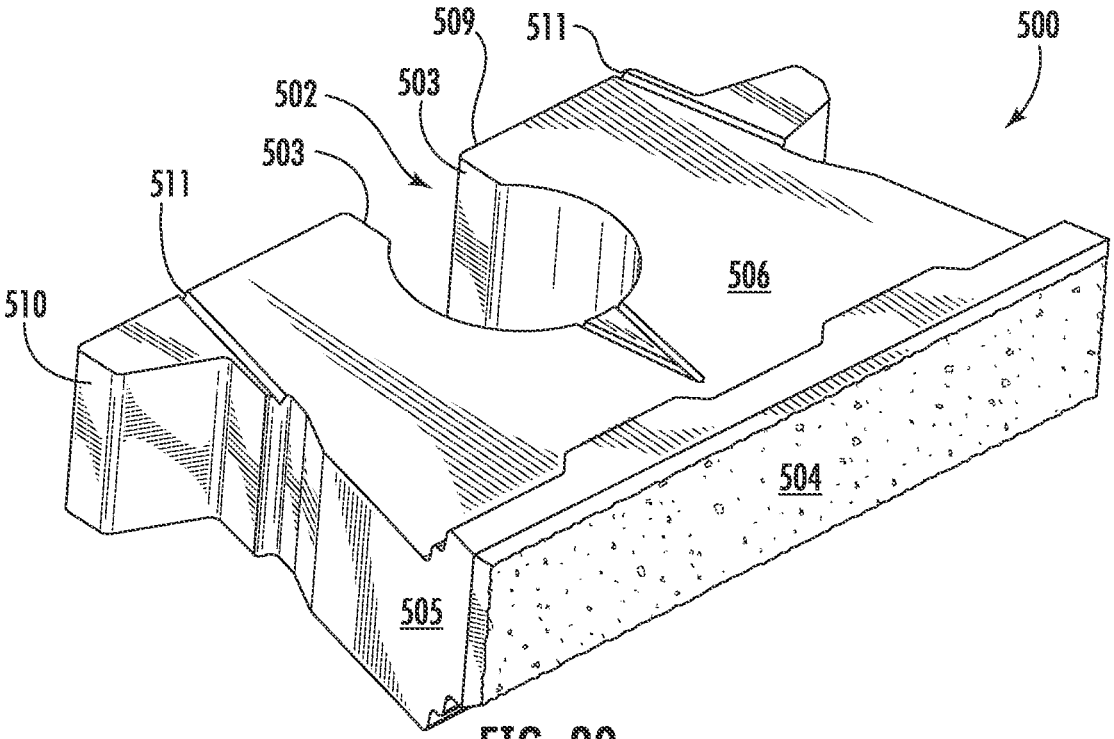
FIG. 30 illustrates a side elevational view of a supporting masonry block.
Figure 31:
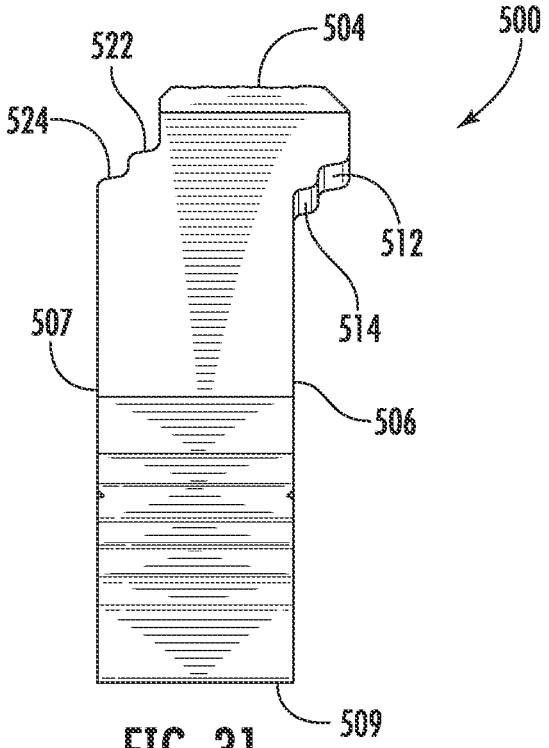
FIG. 31 illustrates a perspective view of a supporting masonry block.
Figure 32:
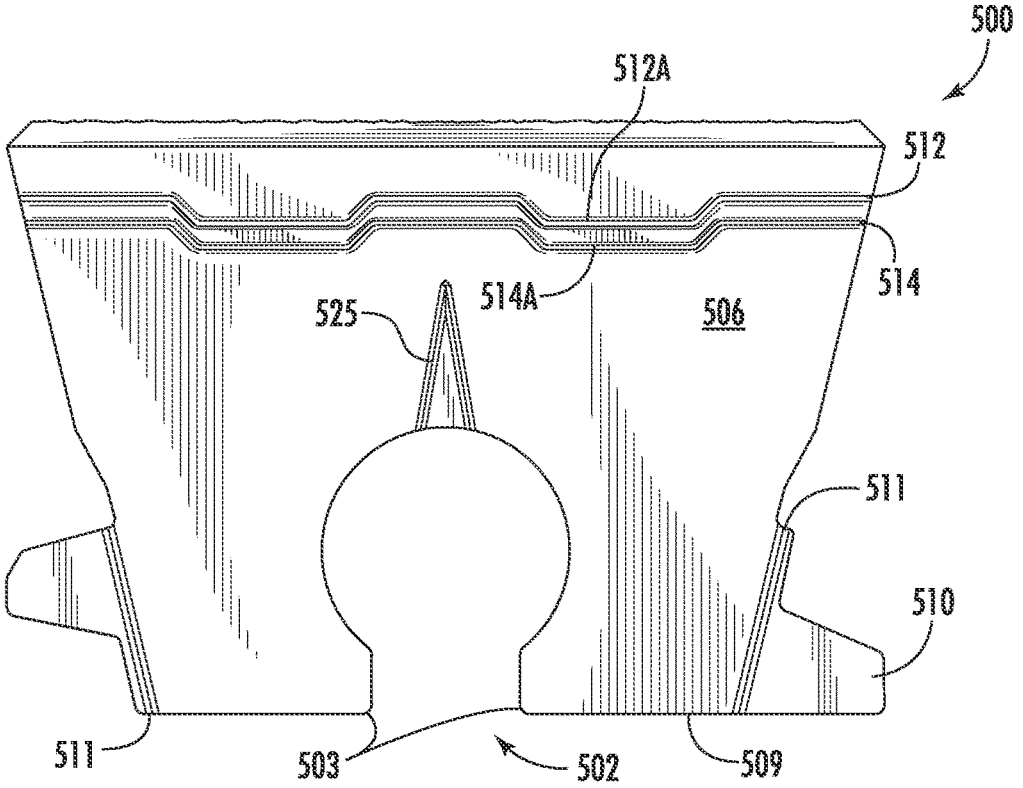
FIG. 32 illustrates a top plan view of a supporting masonry block.
Figure 33:
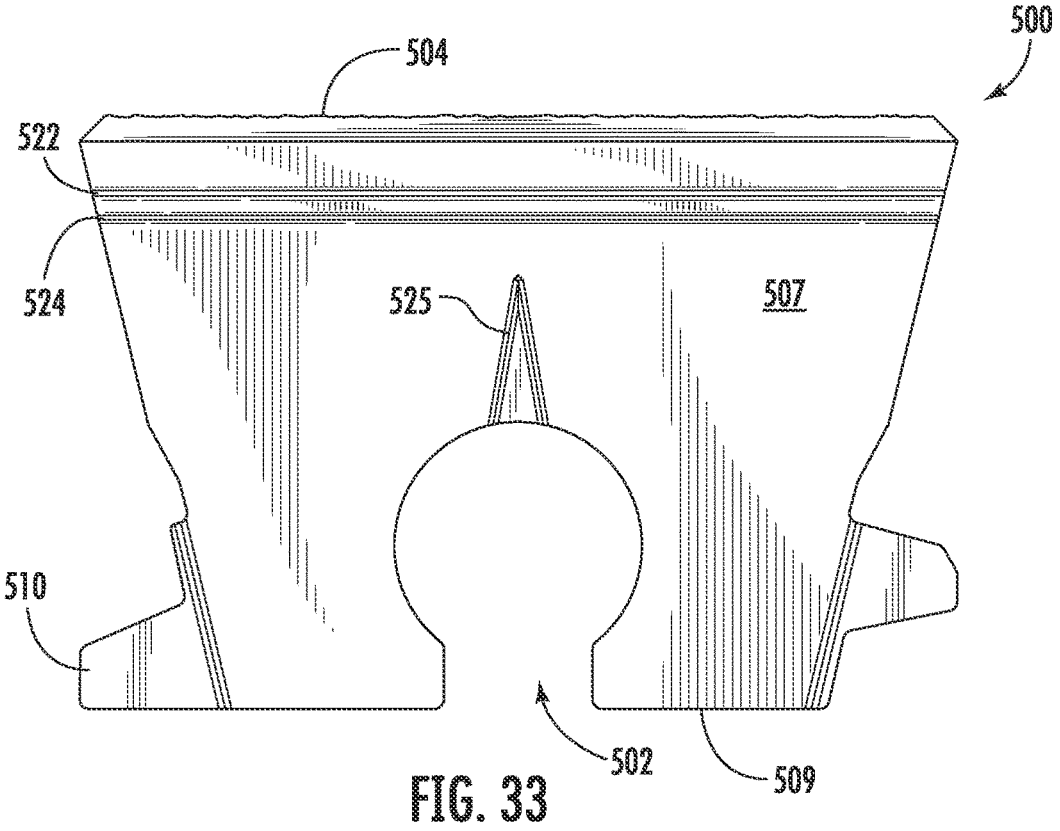
FIG. 33 illustrates a bottom plan view of a supporting masonry block.

Referring to FIG. 29, a perspective view of a wall formed with small corner masonry blocks 300/301, large corner masonry blocks 400/401, and large masonry blocks 200 is shown. It should be noted that for some such walls, small masonry blocks 100 are also used.

Referring to FIGS. 30, 31, 32, and 33, views of a supporting masonry block 500 are shown. The supporting masonry block 500 as a top surface 506, side surfaces 505, supporting masonry block ears 510, a back surface 509, a bottom surface 507, and a front surface 504. In some embodiments, the front surface 504 is textured to match the large masonry block 200, the small masonry block 100, and the corner masonry blocks 300/301/400/401. To mate properly with the other masonry blocks (e.g., the large masonry block 200, the small masonry block 100, and the corner masonry blocks 300/301/400/401), the top surface 506 of the supporting masonry block 500 has supporting masonry block steps 512/514 similar to those of the large masonry block 200, the small masonry block 100, and the corner masonry blocks 300/301/400/401. Likewise, the bottom surface of the supporting masonry block 500 has supporting masonry block notches 522/524 similar to those of the large masonry block 200, the small masonry block 100, and the corner masonry blocks 300/301/400/401. The supporting masonry block steps 512/514 interface with the notches of masonry blocks 100/200/300/301/400/410 that rest upon the supporting masonry block 500. The supporting masonry block notches 522/524 interface with the steps of masonry blocks 100/200/300/301/400/410 upon which the supporting masonry block rests upon, for example, when the supporting masonry block 500 is installed at locations in a wall other than as a foundation masonry block (see FIGS. 37 and 38).

As the supporting masonry block 500 is often used as a foundation block, it is desirable that the supporting masonry block 500 be as heavy as possible. Therefore, the supporting masonry block 500 does not have the masonry block openings 102/202 as do the large and small masonry blocks 100/200. Instead, the supporting masonry block 500 has a tie-back receptacle 502 that is made to be as small as possible while allowing a structurally secure interface with a tie-back 552 (see FIGS. 34 and 35). The tie-back receptacle 502 is shown as being cylindrical with one side of the cylinder open to the back surface 509 of the supporting masonry block 500, though other shapes are equally anticipated. In some embodiments, the tie-back receptacle 502 has narrowing edges 503 to securely retain an end of a tie-back 552 and the tie-back 552 is anticipated to provide resistance from the wall giving way under forces of materials held back by the wall (e.g., soil, aggregate, water).

In some embodiments, score lines 511/525 are formed in the supporting masonry block 500 so that the supporting masonry block 500 is adjustable in size using a hammer and chisel or like device to cut the supporting masonry block 500 along the score lines 511. In the exemplary supporting masonry block 500 shown, score lines 511 are configured to enable removal of one of both supporting masonry block ears 510.

Note that, like the small and large masonry blocks 100/200 described above, in some embodiments, the supporting masonry block 500 also has one or more steps 512/514 (as an example, two are shown) that are staggered (not linear) providing bumps to assist in forming arched or curved walls from multiple of the masonry blocks 100/200/300/301/400/401,500.

Figure 34:
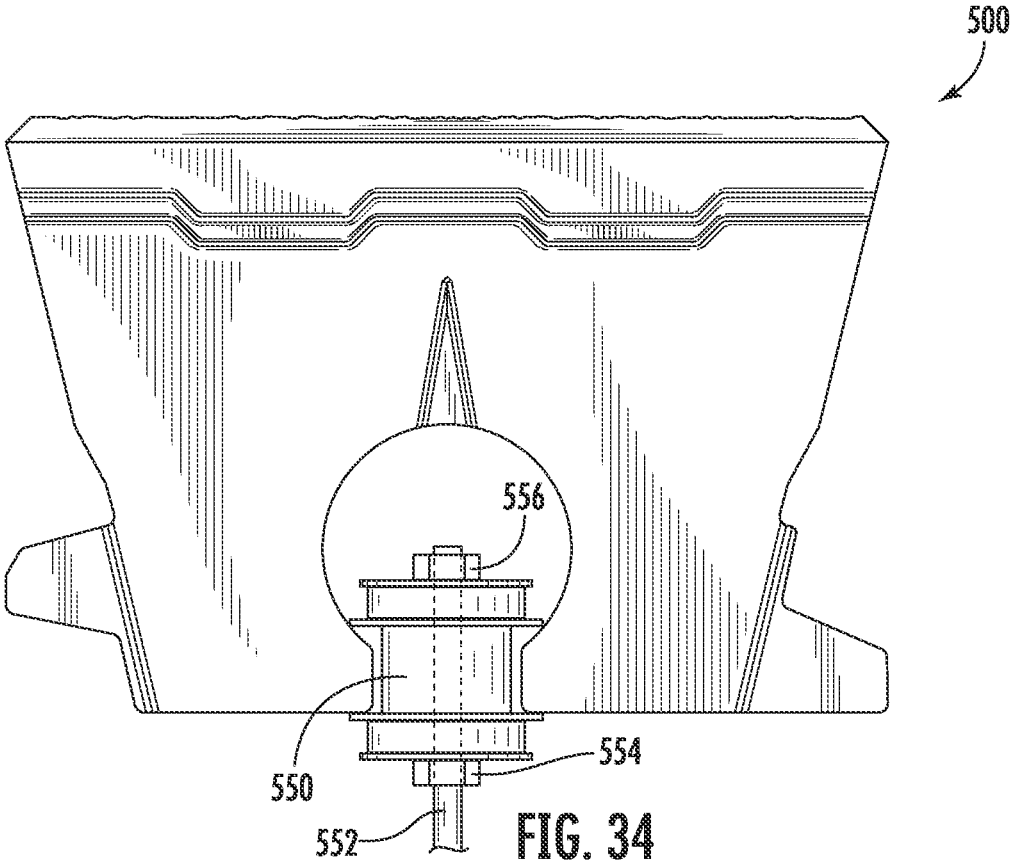
FIG. 34 illustrates a top plan view of a supporting masonry block with a tie-back installed.
Figure 35:
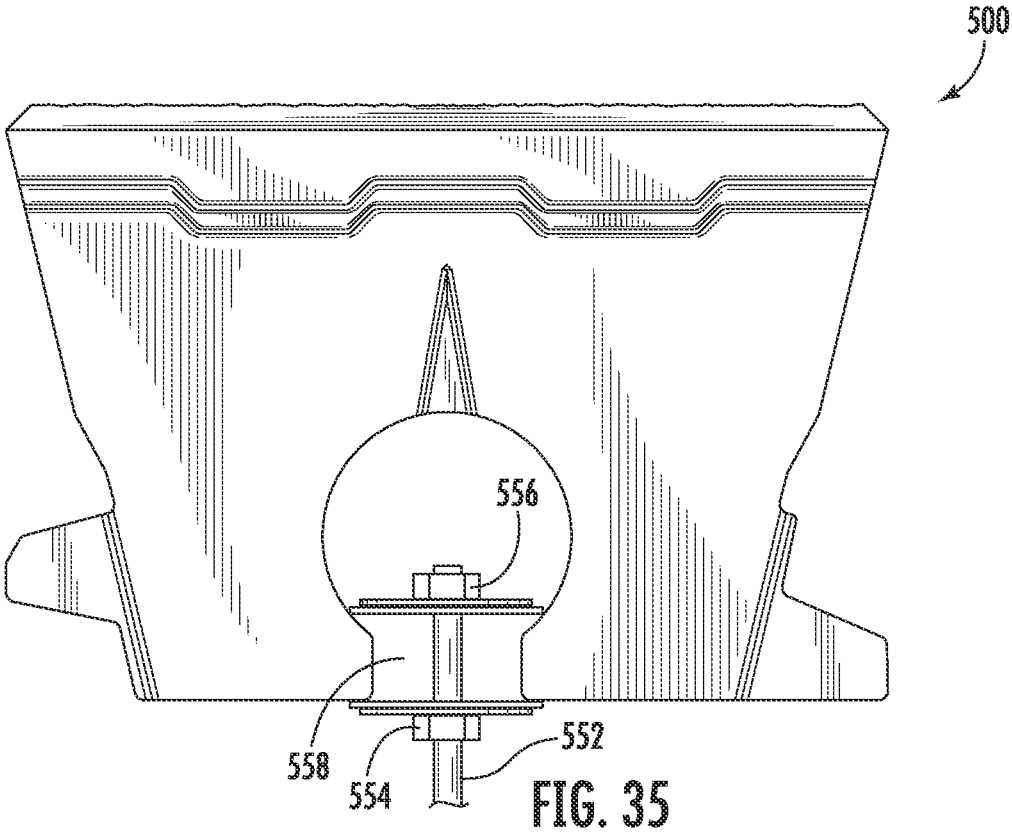
FIG. 35 illustrates a top plan view of a supporting masonry block with a tie-back installed and tightened.

Referring to FIGS. 34 and 35, views of a supporting masonry block 500 are shown with a tie-back 552 installed. In these examples, the tie-back 552 has a locking head 554/556/558 at one end of the tie-back 552, or at both ends of the tie-back 552. In other embodiments, the tie-back 552 has a fixed head (not shown) that has a diameter that is slightly smaller that a diameter of the tie-back receptacle 502 and this diameter is greater than a distance between the narrowing edges 503 such that the fixed head fits within the tie-back receptacle 502 and is held in place between the narrowing edges 503.

In the examples of the tie-back 552 shown in FIGS. 34 and 35, the locking head 554/556/558 has a flange 558 made of a mailable material that, when nuts 556/558 are tightened, the flange 558 expands to lock between the narrowing edges 503. In some embodiments, the flange 558 is made of a cushioning material such as hard rubber to reduce shock waves transferred from the tie-back 552 into the supporting masonry block 500, and therefore, into any wall constructed using the supporting masonry block 500. FIG. 34 shows the flange 550 before tightening of the nuts 556/558 and FIG. 35 shows the flange 550 after tightening of the nuts 556/558.

Figure 36:
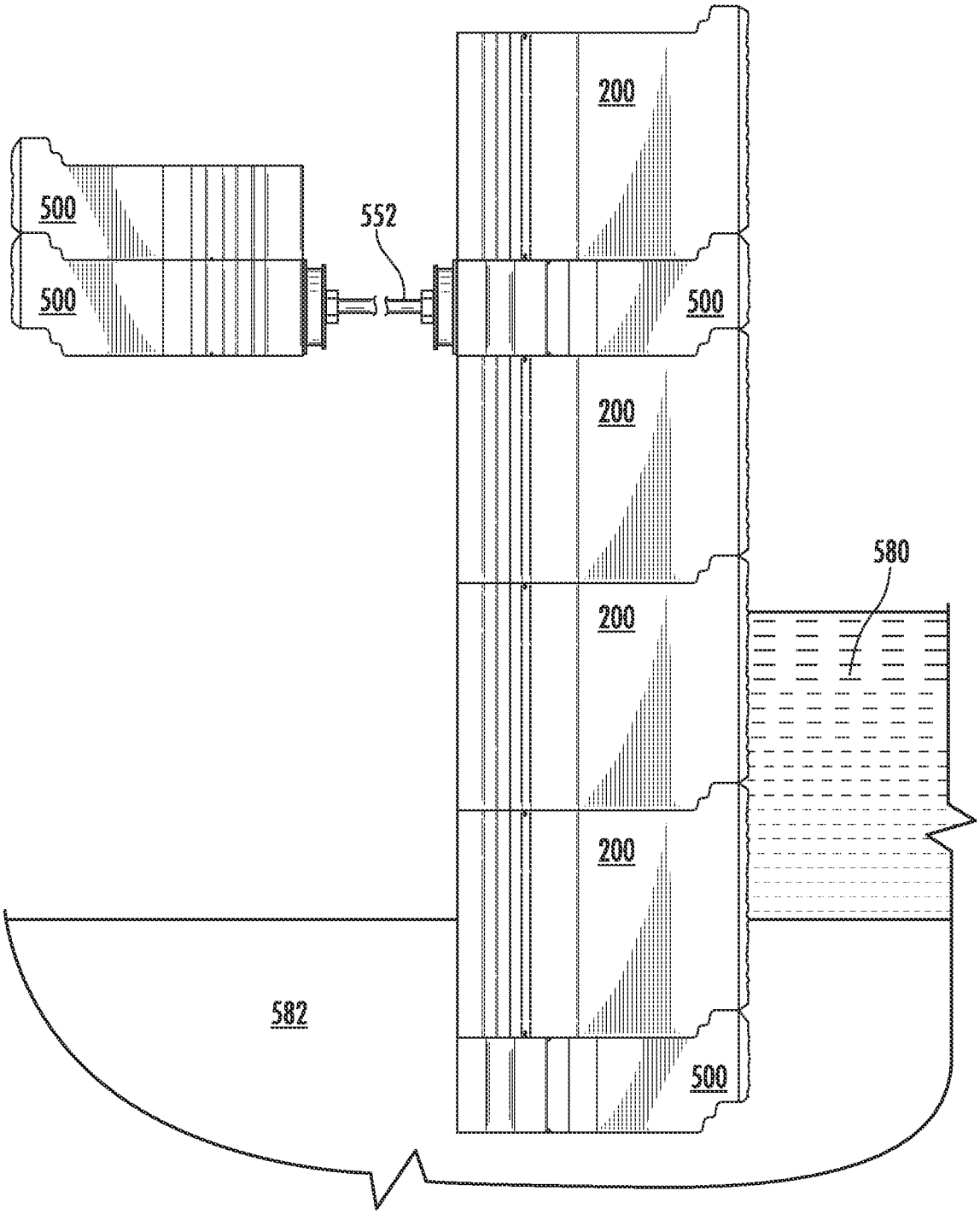
FIG. 36 illustrates a elevational view of a supporting masonry block with a tie-back installed coupled to another supporting masonry block.

Referring to FIG. 36, a side elevational view of a supporting masonry block 500 with a tie-back installed coupled to another supporting masonry block 500. In this usage example, there are two layers of supporting masonry blocks 500, a base layer of supporting masonry blocks 500 serving as a base and an intermediate layer of supporting masonry blocks 500 serving to sure up an upper level of the wall. In this usage scenario, the intermediate layer of supporting masonry blocks 500 are coupled to one or more buried supporting masonry blocks 500 by a tie-back 552. The one or more buried supporting masonry blocks 500 are connected to an opposite end of the tie-back 552 and, once buried, help the wall resist pressure from behind the wall. Note that in this scenario, the base layer of supporting masonry blocks 500 and part of another masonry block 200 are partially buried or set into the supporting earth, much like a foundation. Also, in this example, the wall is directly exposed to water 580, for example, a pond, lake, or stream.

Figure 37:
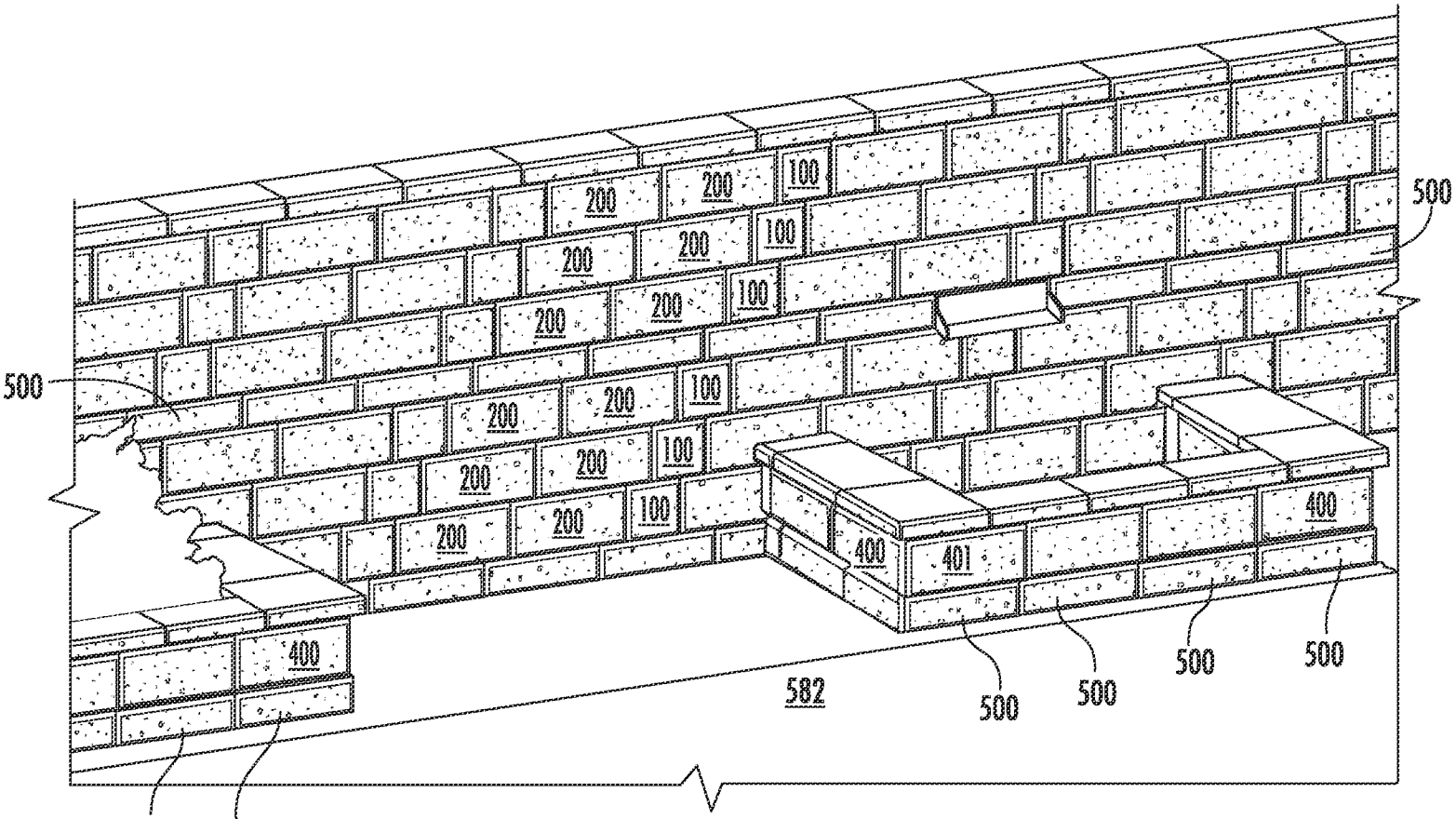
FIG. 37 illustrates a perspective view of a wall and planter using supporting masonry block as support blocks and as intermediate blocks.

Referring to FIG. 37, a perspective view of a wall and planter using supporting masonry block 500 as support blocks and as intermediate blocks. In this view, a wall and planter is created by positioning the supporting masonry blocks on the surface 582 and layering small masonry blocks 100, large masonry blocks 200, corner masonry blocks 400/401, and other layers of supporting masonry blocks 500 are stacked above the supporting masonry blocks 500 to complete the wall and planters.

Figure 38:
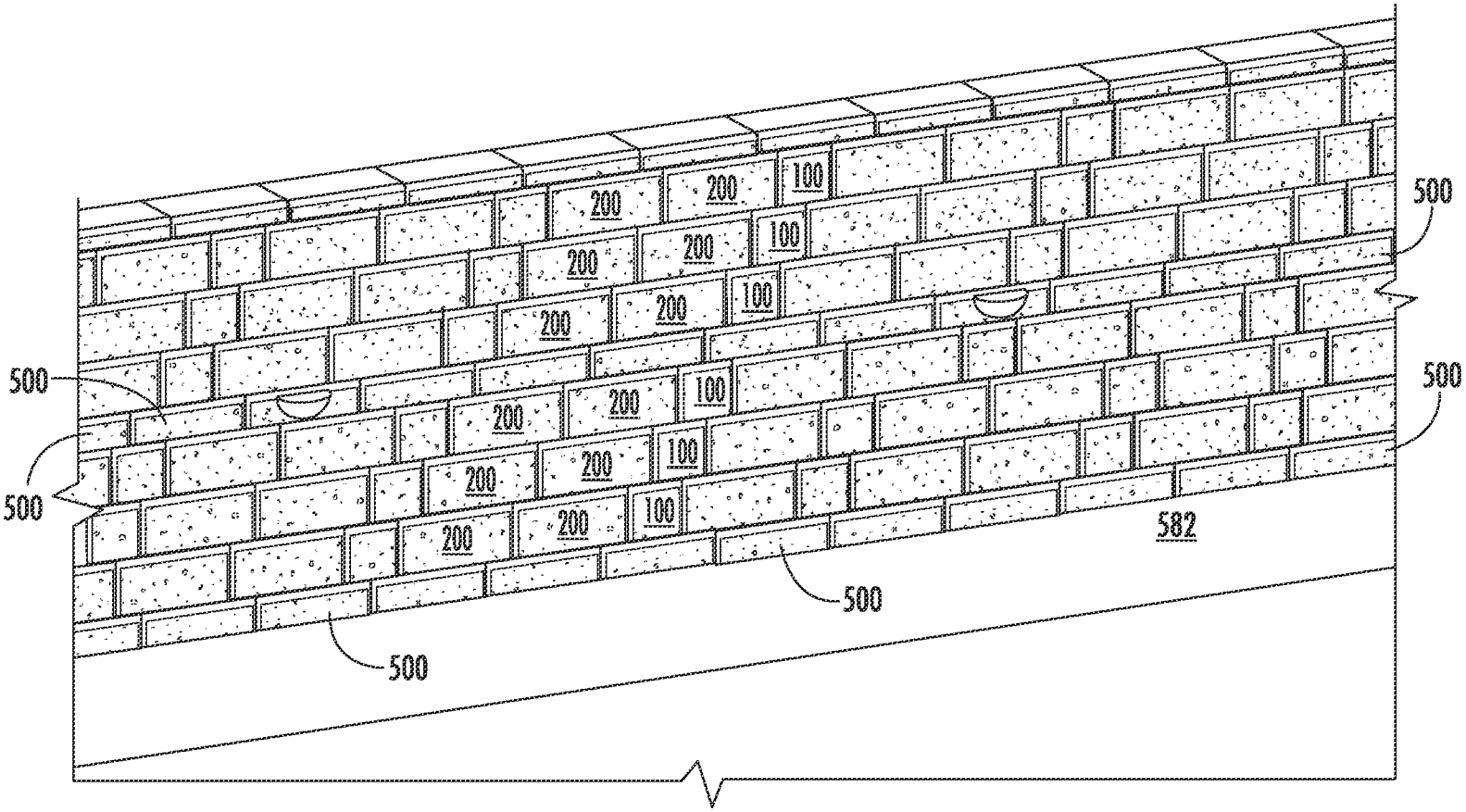
FIG. 38 illustrates a perspective view of a wall and planter using supporting masonry block as support blocks and as intermediate blocks.

Referring to FIG. 38, a perspective view of a wall using supporting masonry block 500 as support blocks and as intermediate blocks. In this view, the supporting masonry blocks are positioned on the surface and layers of small masonry blocks 100, large masonry blocks 200, and other layers of supporting masonry blocks 500 are stacked above the supporting masonry blocks 500.

Equivalent elements can be substituted for the ones set forth above such that they perform in substantially the same manner in substantially the same way for achieving substantially the same result.

It is believed that the system and method as described and many of its attendant advantages will be understood by the foregoing description. It is also believed that it will be apparent that various changes may be made in the form, construction, and arrangement of the components thereof without departing from the scope and spirit of the invention or without sacrificing all of its material advantages. The form herein before described being merely exemplary and explanatory embodiment thereof. It is the intention of the following claims to encompass and include such changes.

The invention claimed is:

1. A supporting masonry block comprising:

a supporting masonry block body having a front surface, a back surface, a top surface, a bottom surface, a first side and a second side, the front surface having a front-top edge and a front-bottom edge, the supporting masonry block having an opening formed between the top surface and the bottom surface;

a tie-back receptacle passing from the top surface, through to the bottom surface, the tie-back receptacle open to the back surface for connecting the supporting masonry block to a tie-back; and at least two steps on the top surface rising above the top surface and formed between the opening and the front-top edge, the at least two steps being setback from the front-top edge by a first setback distance.

2. The supporting masonry block of claim 1, further comprising:

at least two notches in the bottom surface, a first notch of the at least two notches being setback from the front-bottom edge by a second setback distance.

3. The supporting masonry block of claim 2, whereas the first setback distance is greater than the second setback distance and an overall setback is defined by a difference between the first setback distance minus the second setback distance.

4. The supporting masonry block of claim 1, wherein each of the at least two steps are staggered for permitting subsequent layers of masonry blocks to be set at an angle with respect to the supporting masonry block.

5. A method of constructing a structure with masonry blocks, the method comprising:

setting a supporting masonry block having a front surface, a back surface, a top surface, a bottom surface, the front surface having a front-top edge and a front-bottom edge, an opening formed between the top surface and the bottom surface, and a tie-back receptacle passing from the top surface, through to the bottom surface, the tie-back receptacle is open to the back surface for connecting the supporting masonry block to a tie-back, at least two steps on the top surface between the opening and the front-top edge and rising above the top surface, the at least two steps being setback from the front-top edge by a first setback distance; and setting a second masonry block onto the supporting masonry block, the second masonry block having a second masonry block bottom surface and a second masonry block front surface.

6. The method of claim 5, further comprising interfacing the at least two steps with at least one notch formed in the second masonry block bottom surface, a first notch of the at least one notch being setback from the second masonry block front surface by a second setback distance.

7. The method of claim 6, wherein the first setback distance is greater than the second setback distance and an overall setback is defined by a difference between the first setback distance minus the second setback distance.

8. The method of claim 5, further comprising:

installing a head of a tie-back into the tie-back receptacle;

tightening the head of the tie-back; and burying the tie-back in earth behind the supporting masonry block.

9. The method of claim 8, further comprising before burying the tie-back in the earth:

installing a second head of a distal end of the tie-back into a second tie-back receptacle of a second supporting masonry block;

tightening the second head of the tie-back; and burying the tie-back and the second supporting masonry block in the earth behind the supporting masonry block.

10. A masonry block system comprising:

a supporting masonry block having a front surface, a back surface, a top surface, a bottom surface, and side surfaces, the front surface having a front-top edge and a front-bottom edge, the supporting masonry block having an opening formed between the top surface and the bottom surface;

a tie-back receptacle passing from the top surface, through to the bottom surface, the tie-back receptacle is open to the back surface for connecting the supporting masonry block to a tie-back;

one or more masonry blocks, each masonry block of the one or more masonry blocks having a second front surface, a second back surface, a second top surface, a second bottom surface, and second side surfaces, the second front surface having a second front-top edge and a second front-bottom edge; and means for stacking the one or more masonry blocks above the supporting masonry block such that each layer of the one or more masonry blocks are set back from the supporting masonry block or a lower layer of the one or more masonry blocks by a fixed setback distance, the means for stacking comprising at least two steps on the top surface rising above the top surface and formed between the opening and the front-top edge, the at least two steps being setback from the front-top edge by a first setback distance.

11. The masonry block system of claim 10, wherein the tie-back comprises a shaft having a tie-back head at one end of the shaft.

12. The masonry block system of claim 11, wherein the tie-back head has means for tightening after the tie-back head is positioned within the tie-back receptacle.

13. The masonry block system of claim 12, wherein a distal end of the shaft comprises a second tie-back head.

14. The masonry block system of claim 13, wherein the second tie-back head has the means for tightening after the second tie-back head is positioned within the tie-back receptacle of a second supporting masonry block.

15. The masonry block system of claim 14, wherein the tie-back head and/or the second tie-back head comprise a rubber material for use in seismic locations.

* * * * *